US006456861B1

(12) United States Patent
Hidaka et al.

(10) Patent No.: US 6,456,861 B1
(45) Date of Patent: Sep. 24, 2002

(54) HIGH FREQUENCY LOW LOSS ELECTRODE HAVING LAMINATED MAIN AND SUB CONDUCTORS

(75) Inventors: Seiji Hidaka, Nagaokakyo; Shin Abe, Muko; Michiaki Ota, Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/386,637

(22) Filed: Aug. 31, 1999

(30) Foreign Application Priority Data

Sep. 1, 1998 (JP) ..... 10-247000

(51) Int. Cl.[7] ..... H01P 1/213; H01P 1/203; H01P 3/08; H01B 12/02

(52) U.S. Cl. ..... 505/210; 333/204; 333/219; 333/134; 505/700; 505/701; 505/866

(58) Field of Search ..... 333/238, 246, 333/995, 204, 219, 134; 505/210, 700, 701, 866

(56) References Cited

U.S. PATENT DOCUMENTS 2,769,148 A 10/1956 Clogston
6,144,268 A * 11/2000 Matsu et al. ..... 322/134

FOREIGN PATENT DOCUMENTS

| | | |
|---|---|---|
| EP | 0741432 | 11/1996 |
| EP | 0812025 | 12/1997 |
| JP | 993005 | 4/1997 |
| JP | 10013112 | 1/1998 |

* cited by examiner

*Primary Examiner*—Benny T. Lee
(74) *Attorney, Agent, or Firm*—Ostrolenk, Faber, Gerb & Soffen, LLP

(57) ABSTRACT

A high frequency low loss electrode includes a main conductor and at least one sub-conductors formed along a side of the main conductor. At least one of the at least one sub-conductor has a multi-layer structure in which thin-film conductors and thin-film dielectrics are alternately laminated.

31 Claims, 21 Drawing Sheets

FIG. 7A
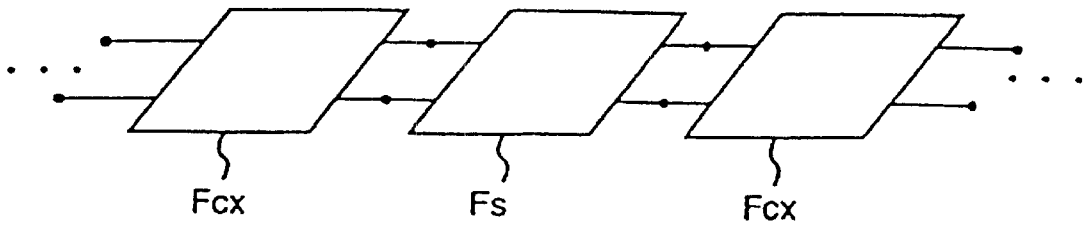
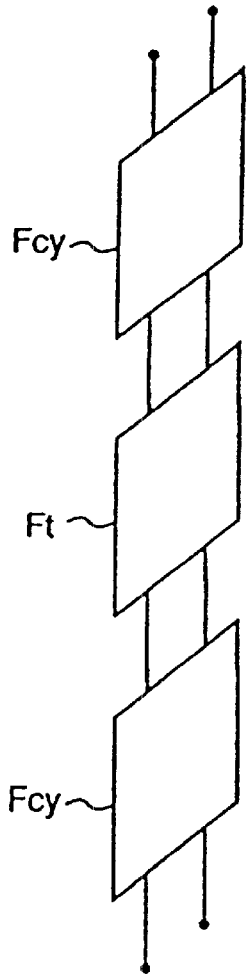
FIG. 7B

HIGH FREQUENCY LOW LOSS ELECTRODE HAVING LAMINATED MAIN AND SUB CONDUCTORS

CROSS-REFERENCE TO RELATED APPLICATION

This application is related to the same inventors' commonly-assigned U.S. Ser. No. 09/387,331 filed on Aug. 31, 1999, also titled HIGH FREQUENCY LOW LOSS ELECTRODE, the disclosures of which are incorporated by reference.

BACKGROUND OF THE INVENTION

1. Field of the Invention

The present invention relates to a high frequency low loss electrode for use in transmission lines and resonators operative in a microwave band and a millimeter wave band which are used mainly in radio communications, a transmission line, a high frequency resonator, a high frequency filter, an antenna sharing device, and communications equipment, each including the high frequency low loss electrode.

2. Description of the Related Art

Strip-type transmission lines and microstrip-type transmission lines, which can be easily produced and of which the size and weight can be reduced, are generally used in microwave IC's and monolithic microwave IC's operated at a high frequency. Resonators for such uses, in which the above-described lines have a length equal to a quarter-wavelength or a half-wavelength, or a circular resonator containing a circular conductor, are employed. The transmission loss of these lines and the unloaded Q of the resonators are determined mainly by the conductor loss. Accordingly, the performance of the microwave IC's and the monolithic microwave IC's depends on how much the conductor loss can be reduced.

These lines and resonators are formed with conductors with a high conductivity such as copper, gold, or the like. However, the conductivities of metals are inherent to the materials. There are limits to how much the loss can be reduced by selecting a metal with a high conductivity, and forming the metal into an electrode. Accordingly, great attention has been given to the fact that at the high frequency of a microwave or a millimeter wave, a current is concentrated at the surface of an electrode, due to the skin effect, and most of the loss occurs in the vicinity of the surface (hereinafter the "surface portion") of the conductor.

It has been attempted to reduce the conductor loss from the standpoint of the structure of the electrode. For example, in Japanese Unexamined Patent Publication 8-321706, a structure is disclosed in which plural linear conductors with a constant width are arranged in parallel to the propagation direction at constant intervals to reduce the conductor loss. Moreover, in Japanese Unexamined Patent Publication 10-13112, a structure is disclosed in which the surface portion of an electrode are divided into plural parts, so that a current concentrated at the portion is dispersed to reduce the conductor loss.

However, the method in which the whole of an electrode is divided into plural conductors having an equal width as disclosed in Japanese Unexamined Patent Publication 8-321706 has the problem that the effective cross-sectional area of the electrode is decreased, so that the conductor loss cannot be effectively reduced.

The method in which the surface portion of the electrode is divided into plural sub-conductors having substantially the same width, as disclosed in Japanese Unexamined Patent Publication 10-13112, is effective to some degree in relaxing the current concentration and reducing the conductor loss. However, for modern high-frequency communications applications, further improvement is needed.

SUMMARY OF THE INVENTION

Accordingly, it is an object of the invention to provide a high frequency low loss electrode having reduced conductor loss.

It is another object of the present invention to provide a transmission line, a high frequency resonator, a high frequency filter, an antenna sharing device, and communications equipment, each having a low loss due to the use of the above-described high frequency low loss electrode.

The present invention has been achieved based on a finding that in an electrode having an end portion divided into plural sub-conductors, the conductor loss can be effectively reduced by setting the widths of the sub-conductors according to a predetermined principle.

According to the present invention, there is provided a first high frequency low loss electrode which comprises a main conductor, and at least one sub-conductor formed along a side of the main conductor, said at least one sub-conductor having a multi-layer structure in which thin-film conductors and thin-film dielectrics are laminated alternately.

Preferably, in the first high frequency low loss electrode of the present invention, the sub-conductor positioned nearest to the outside of the sub-conductors has a width smaller than ($\pi/2$) times the skin depth $\delta$ at an applied frequency. Accordingly, an ineffective current in the sub-conductor positioned nearest to the outside can be reduced. More preferably, in order to reduce an ineffective current in the sub-conductor positioned nearest to the outside, the width of the sub-conductor is set at a value smaller than ($\pi/4$) times the skin depth $\delta$ at an applied frequency.

More preferably, in the first high frequency low loss electrode of the present invention, when the high frequency low loss electrode includes the plural sub-conductors, the width of each of the sub-conductors is smaller than ($\pi/2$) times the skin depth $\delta$ at an applied frequency.

Still more preferably, in the first high frequency low loss electrode of the present invention, when the high frequency low loss electrode includes the plural sub-conductors, the plural sub-conductors are formed so that a sub-conductor thereof positioned nearer to the outside is thinner. Accordingly, the conductor loss can be effectively reduced.

Further, in the first high frequency low loss electrode of the present invention, sub-dielectrics may be provided between the main conductor and the sub-conductor adjacent to the main conductor and between adjacent sub-conductors, respectively.

Preferably, in the first high frequency low loss electrode of the present invention, the interval between the main conductor and the sub-conductor adjacent to the main conductor, and the intervals between adjacent sub-conductors, are formed so that an interval thereof positioned nearer to the outside is shorter, corresponding to the widths of the respective adjacent sub-conductors, in order to cause currents substantially in phase to flow through the sub-conductors.

Further, in the first high frequency low loss electrode of the present invention, when the high frequency low loss electrode includes the sub-dielectrics, the plural sub-dielectrics may be formed so that a sub-dielectric thereof positioned nearer to the outside has a lower dielectric constant.

Preferably, in the first high frequency low loss electrode of the present invention, the thin-film conductors in the sub-conductor having a multi-layer structure are formed so that a thin-film conductor lying further inside the multi-layer structure is thicker.

According to the present invention, there is provided a second high frequency low loss electrode which comprises a main conductor, and plural sub-conductors formed along a side of the main conductor, the sub-conductors being formed so that a sub-conductor thereof positioned nearer to the outside has a smaller width, at least one of the sub-conductors having a multi-layer structure in which thin-film conductors and thin-film dielectrics are laminated alternately.

Preferably, in the second high frequency low loss electrode of the present invention, at least one of the sub-conductors is set at a width smaller than ($\pi/2$) times the skin depth $\delta$ at an applied frequency in order to reduce the ineffective current.

More preferably, in the second high frequency low loss electrode of the present invention, at least one of the sub-conductors is set at a width smaller than ($\pi/4$) times the skin depth $\delta$ at an applied frequency in order to reduce a more ineffective current.

Also, in the second high frequency low loss electrode of the present invention, sub-dielectrics may be provided between the main conductor and the sub-conductor adjacent to the main conductor and between adjacent sub-conductors, respectively.

Preferably, in the second high frequency low loss electrode of the present invention, the interval between the main conductor and the sub-conductor adjacent to the main conductor and the intervals between adjacent sub-conductors are set so that an interval thereof positioned nearer to the outside is shorter, corresponding to the widths of the respective adjacent sub-conductors in order that currents substantially in phase are made to flow through the sub-conductors.

More preferably, in the second high frequency low loss electrode of the present invention, the dielectric constants of the plural sub-dielectrics are set so that the dielectric constant of a sub-dielectric positioned nearer to the outside of the plural sub-dielectrics is lower, corresponding to the widths of the adjacent sub-conductors, in order that currents substantially in phase are made to flow through the respective sub-conductors.

Still more preferably, in the second high frequency low loss electrode of the present invention, in the sub-conductor having a multi-layer structure, the thin-film conductors are formed so that a thin-film conductor thereof lying at a position further inside is thicker. Accordingly, the conductor loss of the sub-conductors having a multi-layer structure can be reduced.

According to the present invention, there is provided a third high frequency low loss electrode which comprises a main conductor and plural sub-conductors formed along a side of the main conductor, the sub-conductors, except optionally at least one sub-conductor positioned nearest to the outside of the sub-conductors, having a multi-layer structure in which thin-film conductors and thin-film dielectrics are laminated alternately, the sub-conductors being formed so that a sub-conductor thereof positioned nearer to the outside has fewer laminated thin-film conductors.

Preferably, in each of the first through third high frequency low loss electrodes of the present invention, the main conductor is a thin-film multi-layer electrode comprising thin-film conductors and thin-film dielectrics laminated alternately.

Preferably, in each of the first through third high frequency low loss electrodes of the present invention, at least one of the main conductor and the sub-conductors is made of a superconductor.

Also according to the present invention, there is provided a first high frequency resonator which includes any one of the first through third high frequency low loss electrodes of the present invention.

Also according to the present invention, there is is provided a first high frequency transmission line which includes any one of the first through third high frequency low loss electrodes of the present invention.

Preferably, a second high frequency resonator of the present invention includes the first high frequency transmission line of which the length is set at a quarter-wavelength multiplied by an integer.

More preferably, a third high frequency resonator of the present invention includes the above-described first high frequency transmission line of which the length is set at a half-wavelength multiplied by an integer.

Also according to the invention, a high frequency filter of the present invention includes any one of the first through third high frequency resonators.

Further, the invention provides an antenna sharing device which includes the high frequency filter.

Further, the invention provides communications equipment which includes one of the high frequency filter and the antenna sharing device.

Other features and advantages of the present invention will become apparent from the following description of embodiments of the invention which refers to the accompanying drawings.

BRIEF DESCRIPTION OF THE DRAWINGS

FIG. 7A is a one-dimensional equivalent circuit diagram in one direction of the multi-layer multi-line model of FIG. 5C and FIG. 6;

FIG. 7B is a one-dimensional equivalent circuit diagram in another direction of the multi-layer multi-line model of FIG. 5C and FIG. 6;

DETAILED DESCRIPTION OF EMBODIMENTS OF THE INVENTION

Figure 1:
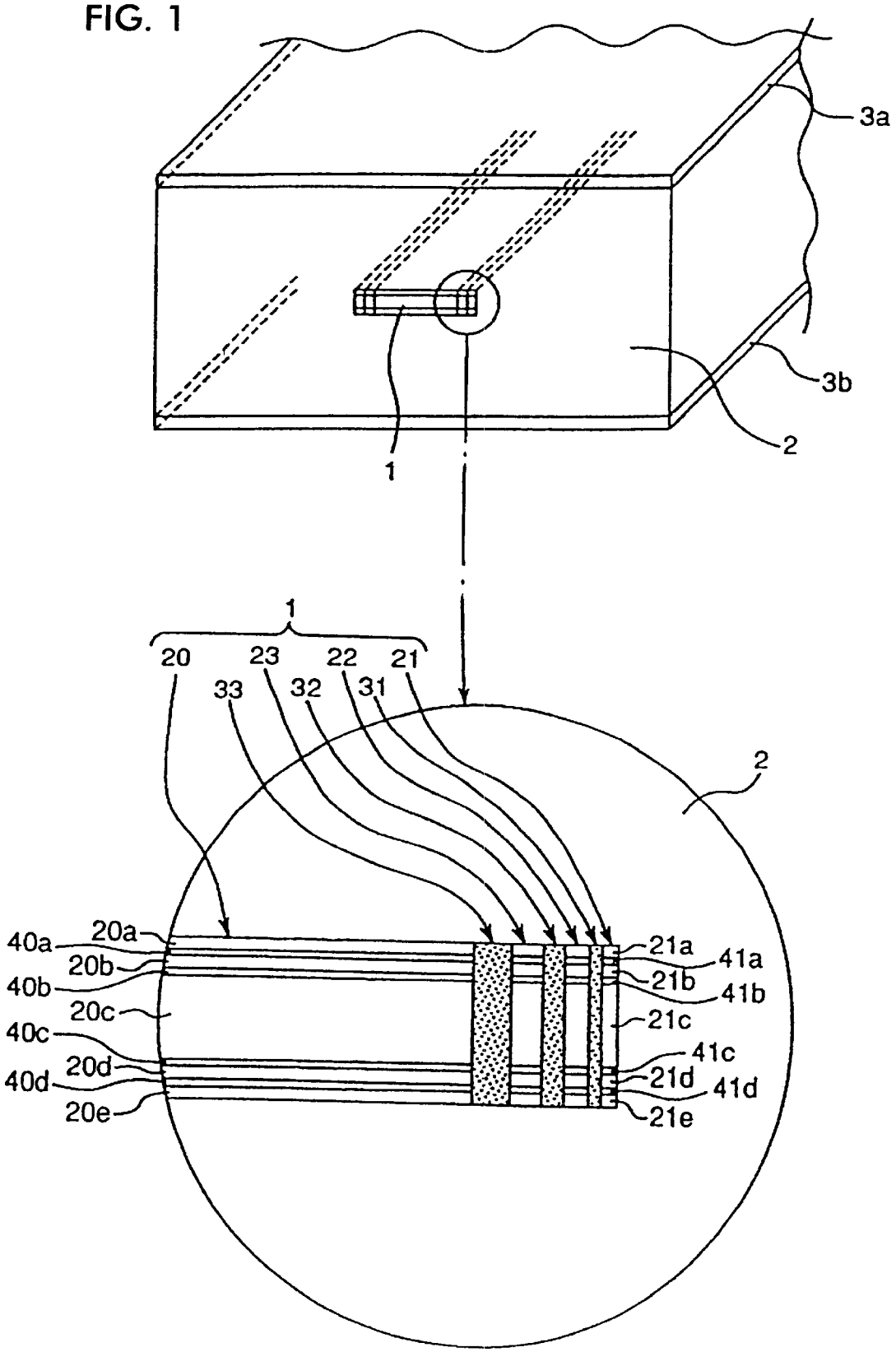
FIG. 1 is a triplet type strip line including a high frequency low loss electrode according to an embodiment of the present invention.

Hereinafter, a high frequency low loss electrode according to an embodiment of the present invention will be described. FIG. 1 shows a triplet type strip line including the high frequency low loss electrode 1 of the embodiment. The strip line has the configuration in which the high frequency low loss electrode 1 having a predetermined width is formed in the center of a dielectric 2 with a rectangular cross-section, and ground electrodes 3*a* and 3*b* are formed in parallel to the high frequency low loss electrode 1. In the high frequency low loss electrode 1 of this embodiment, as shown in the enlarged view of FIG. 1, the end portion is divided into sub-conductors 21, 22, and 23, so that an electric field concentrated in the end portion is dispersed, and the conductor loss at a high frequency is reduced. In this embodiment, the sub-conductors 21, 22, and 23 are formed to have a lamination structure in which thin-film conductors and thin-film dielectrics are laminated alternately, and thereby, the conductor loss in the sub-conductors 21, 22, and 23 is reduced, that is, the conductor loss in the end portion of the high frequency low loss electrode is reduced.

In particular, in the high frequency low loss electrode 1 of this embodiment, the sub-conductor 23 is formed to be adjacent to the main conductor 20 through a sub-dielectric 33. The sub-dielectric 32, the sub-conductor 22, the sub-dielectric 31, and the sub-conductor 21 are formed sequentially toward the outside in that order. The sub-conductors 23, 22, and 21 are formed so that the respective widths of the sub-conductors decrease toward the outside (more distant from the main conductor) to reduce the conductor loss of all the sub-conductors. The sub-conductors 21, 22, and 23 are formed to have a width of up to $\pi/2$ times the skin depth $\delta$ at an applied frequency, and the respective widths of the sub-dielectrics 33, 32, and 31 are set so that currents substantially in phase flow through the respective sub-conductors 21, 22, and 23. Accordingly, the concentration of an electric field in the end portion of the electrode, which is caused when no sub-conductors are provided, can be effectively dispersed in the respective sub-conductors 21, 22, and 23.

Further, the sub-conductor 21 has a multi-layer structure in which a thin-film conductor 21*a*, a thin-film dielectric 41*a*, a thin-film conductor 21*b*, a thin-film dielectric 41*b*, a thin-film conductor 21*c*, a thin-film dielectric 41*c*, a thin-film conductor 21*d*, a thin-film dielectric 41*d*, and a thin-film conductor 21*e* are laminated.

In the sub-conductor 21, the thin-film conductors 21*a*, 21*b*, 21*c*, 21*d*, and 21*e* are formed so that the respective thicknesses of the thin-film conductors increase toward the inside, in order that the conductor loss of the sub-conductor is reduced. The film-thicknesses of the thin-film dielectrics 41*a*, 41*b*, 41*c*, and 41*d* are set so that currents substantially in phase flow through the thin-film conductors 21*a*, 21*b*, 21*c*, 21*d*, and 21*e*, correspondingly. In this embodiment, the sub-conductors 22 and 23 are formed in the same manner as the sub-conductor 21.

The film-thicknesses of the thin-film conductors 21*a*, 21*b*, 21*c*, 21*d*, and 21*e* which are preferable for reduction of the conductor loss of the sub-conductors, and the film-thicknesses of the thin-film dielectrics 41*a*, 41*b*, 41*c*, and 41*d* which are preferable for making currents flow substantially in phase through the thin-film conductors 21*a*, 21*b*, 21*c*, 21*d*, and 21*e* will be described later.

Hereinafter, as regarding the high frequency low loss electrode 1 of this embodiment, a method of setting the line-widths of the sub-conductors and the widths of the sub-dielectrics will be described.

1. Currents and Phases in Respective Sub-conductors (Current Densities and Phases Inside Conductor)

Figure 2:
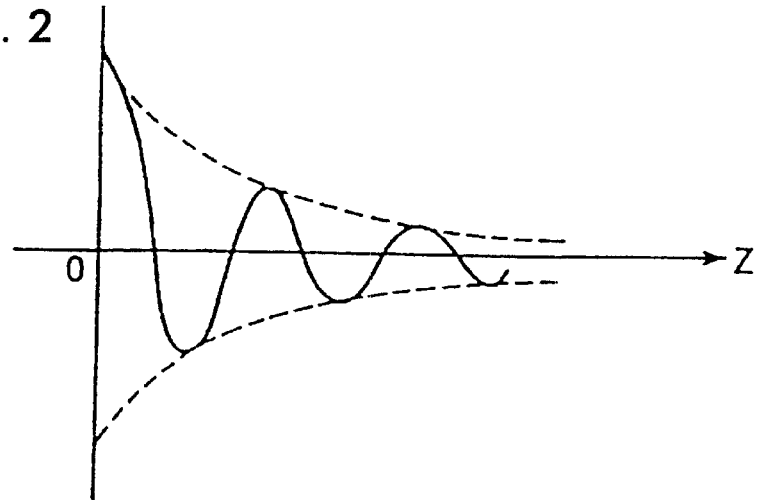
FIG. 2 is a graph showing the attenuation of a current density inside a conductor.

In general, the current density function J(z) inside a conductor is expressed by the following mathematical formula 1, caused by the skin effect which occurs at a high frequency. In the mathematical formula 1, z represents a distance in the depth direction from the surface taken as the reference (0), and $\delta$ represents the skin depth at an angular frequency $\omega$ ($=2\pi f$) which is expressed by the mathematical formula 2. Further, a represents a conductivity, and $\mu_0$ permeability in vacuum. Accordingly, inside of the conductor, the current density is decreased at a position 2 deeper from the surface as shown in FIG. 2.

$$J(z)=J_0e^{-(1+j)}Z/\delta(A/m^2) \quad \text{[mathematical formula 1]}$$

$$\delta=\sqrt{2/\omega\mu_0}\sigma \quad \text{[mathematical formula 2]}$$

Accordingly, the absolute value of the amplitude of the current density is expressed by the following mathematical formula 3, and is attenuated to 1/e at z=$\delta$. The phase of the amplitude of the current density is expressed by the mathematical formula 4. As z is increased (namely, at a position deeper from the surface), the phase is increased in the negative direction, and at z=$\delta$ (surface skin depth), the phase is decreased by 1 rad (about 60°) as compared with that at the surface.

$$abs(J(z))=|J_0|e^{-z/\delta} \quad \text{[mathematical formula 3]}$$

$$arg(J(z))=-z/\delta \quad \text{[mathematical formula 4]}$$

Accordingly, a power loss $P_{loss}$ is expressed by the following mathematical formula 5 using resistivity $\rho=1/\sigma$. The overall power loss $P^0_{loss}$ of a conductor which is sufficiently thick is expressed by the formula 6. At z=$\delta$, $(1-e^2)$ of the overall power loss $P^0_{loss}$, namely, 86.5% is lost.

$$P_{loss} = \int_0^z p|J(z)|^2 dz(\rho = 1/\sigma : \text{resistivity}$$
$$= p|J_0|^2\delta/2(1-e^{-2z/\delta})$$

$$P_{loss}{}^0=\rho|J_0|^2\delta/2 \quad \text{[mathematical formula 6]}$$

Further, by using the current density function J(z), the surface current K is given by the following mathematical formula 7. The surface current K is a physical quantity which is coincident with the tangential component of a magnetic field (hereinafter, referred to as a surface magnetic field) at the surface of a conductor. The surface current K is in phase with the surface magnetic field, and has the same dimension as the surface magnetic field, namely, the dimension of A/m.

$$K = \int_0^\infty J(z)dz = \delta J/(1+j)$$

Figure 3:
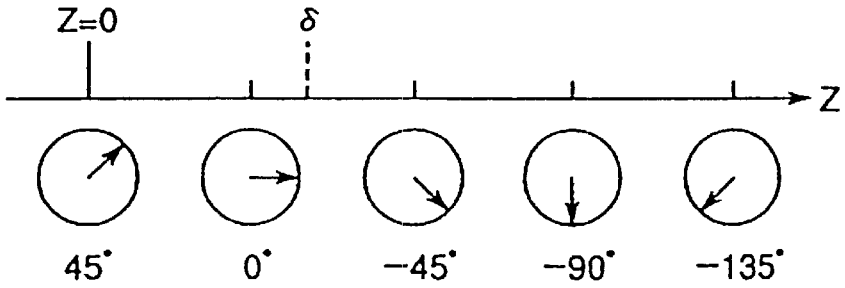
FIG. 3 illustrates the phase change of a current density inside of a conductor.

As seen in the mathematical relation formula 7, the phase of the current density $J_0$ at the surface is 45°, if observed at the time when the phase of the surface current K (namely, the surface magnetic field) is 0°, Accordingly, the phase of the current density function J(z) inside the conductor can be illustrated by a model as shown in FIG. 3. Further, when the phase of the current density $J_0$ is 45°, the surface current K is given by the following formula 8.

$$F=|K|=\delta|J_0|/\sqrt{2} \quad \text{[mathematical formula 8]}$$

Assuming that the phase of the current density amplitude is not changed with the depth (it behaves like direct current), the surface current K' is expressed by following formula 9.

$$K' = \int_0^\infty |J_0|e^{-2/\delta}dz$$
$$= \delta|J_0|$$

As understood by the comparison of the formulae 8 and 9, the surface current K at a high frequency is decreased to be $1/\sqrt{2}=70.7\%$ as compared with the surface current K' of the direct current. It is speculated that this is because an ineffective current flows. In fact, it can be recognized that the overall power loss calculated based on the formula 9 can be expressed by the formula 5.

On the other hand, if the current density expressed by the formula 9 is multiplied by $1/\sqrt{2}$ so that the surface currents are equal to each other, the overall power loss, on the condition that the equal surface currents are realized, will be $(1/\sqrt{2})^2=½=50\%$.

Accordingly, under the ideal limit condition that the phases of the current densities are made equal to 0°, and the phases suffer no changes inside the conductor, the power loss can be reduced to 50%. Practically, since the phase of the current density is decreased inside the conductor, it is difficult to realize the above-described ideal state.

(Current and Phase in Each Sub-conductor)

Figure 4:
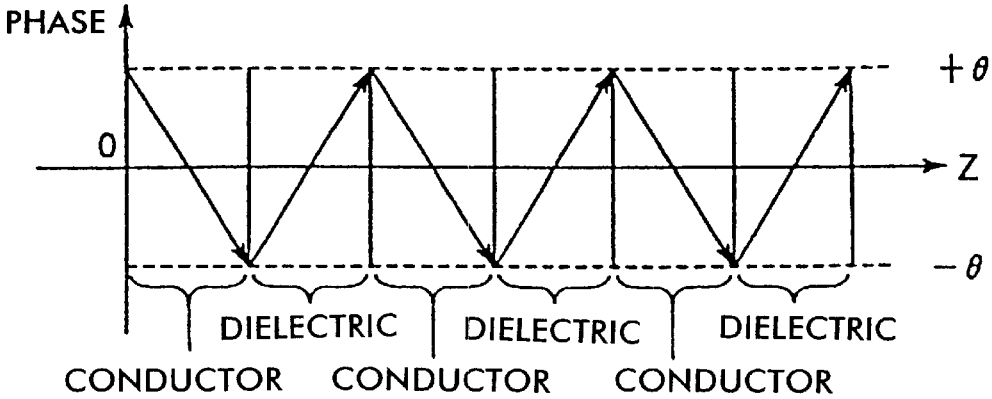
FIG. 4 illustrates the phase change of a current density when conductors and dielectrics are alternately arranged.

However, in the multi-line structure in which sub-conductors and sub-dielectrics are alternately arranged, the periodic structure in which the phase is changed periodically in the range of ±θ as shown in FIG. 4 can be realized by utilization of the phenomenon that the phase of a current density inside a dielectric increases. That is, characteristically, in the high frequency low loss electrode 1 of this embodiment, the structure is realized in which the phases of the current densities inside the sub-conductors are changed periodically in a relative small range with respect to the center of 0, by setting θ at a small value in the above-described periodic structure, and thereby, an ineffective current is reduced.

Accordingly, from the above discussion, the following two points to be preferred and satisfied for the high frequency low loss electrode 1 of this embodiment can be derived.

(1) The line-width of each sub-conductor is set so that the change width (2θ) of the current density phase is small. As seen in the above description, the narrower the line-width of the sub-conductor, the more the change width of the phase can be more reduced, to reach the above-described ideal state. Practically, in consideration of the manufacturing cost, the phase is set preferably at $\theta \leqq 90°$, and more preferably at $\theta \leqq 45°$.

The setting at $\theta \leqq 90°$ can be achieved by setting the line width of each sub-conductor at $\pi\delta/2$ or lower. Further, the setting at $\theta \leqq 45°$ can be made by setting the line-width of each sub-conductor at $\pi\delta/4$ or lower.

(2) The widths of the sub-dielectrics are set so that the changed current density phases in the respective sub-conductors lying on the current-approaching side are cancelled out.

2. Analysis of Multi-Line Structure by Equivalent Circuit

Hereinafter, the multi-line structure of the high frequency low loss electrode 1 of the present invention will be described in reference to a simplified modeled structure.

Figure 5A:
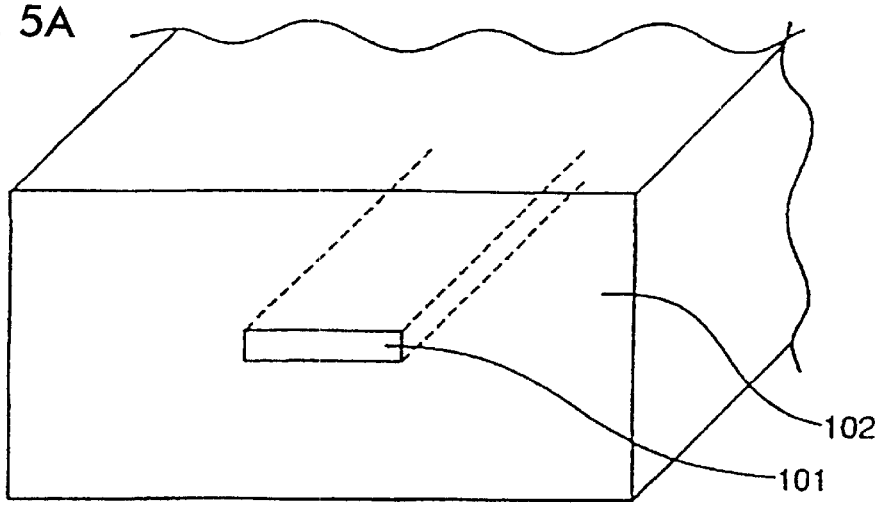
FIG. 5A is a perspective view of a triplet type strip line model for analysis of a multi-line structure electrode according to the present invention.
Figure 5B:
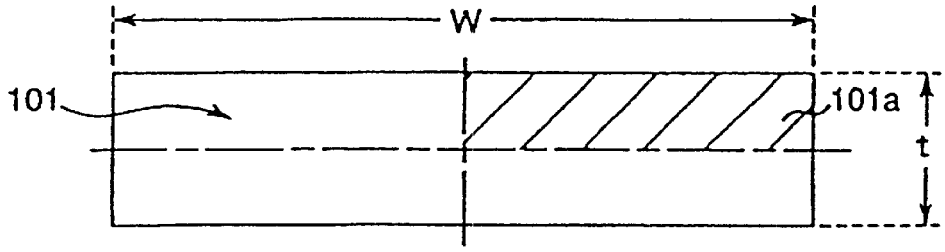
FIG. 5B is an enlarged cross-sectional view of the strip conductor in the model of FIG. 5A.
Figure 5C:
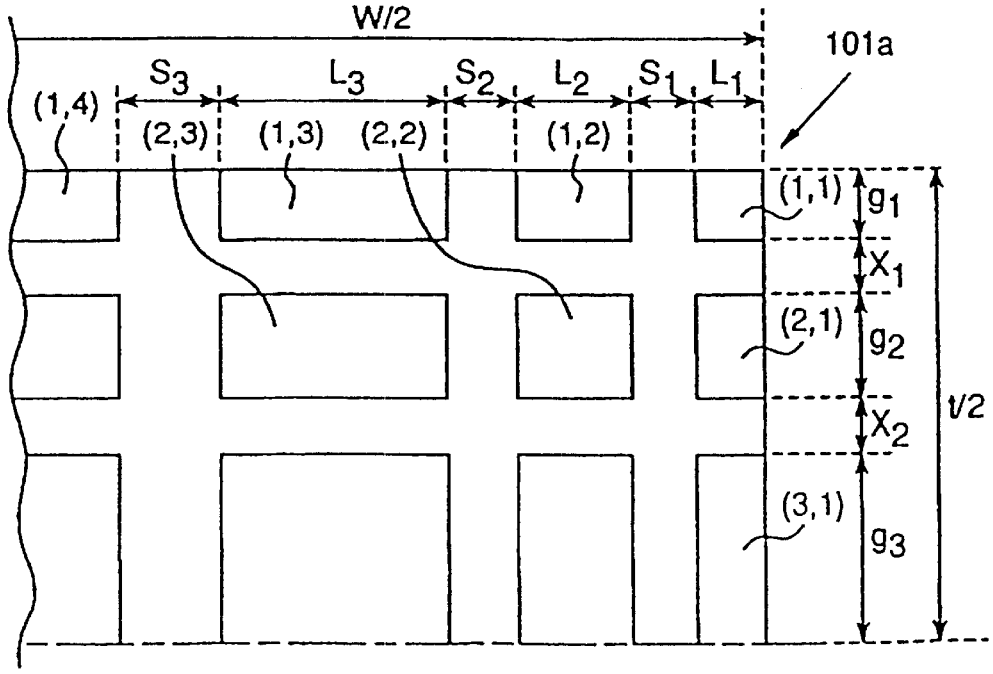
FIG. 5C is a further enlarged cross-sectional view of the strip conductor.

FIG. 5A shows a triplet type strip line model which can be analyzed relatively easily, and will be used in the following description. The model has the configuration in which a strip conductor 101 with a rectangular cross-section is provided in a dielectric 102. The strip conductor 101 is configured so that the cross-section is symmetric with respect to right and left and upper and lower sides as shown in FIG. 5B. Further, as shown in FIG. 5C, which is an enlarged view of part of the conductor segment 101*a* in FIG. 5B, the strip conductor 101 has the above-described multi-line structure in an end portion thereof, and is composed of multi-layers in the thickness direction. More particularly, the strip conductor 101 is composed of many sub-conductors, and has the matrix structure in which the sub-conductors (1, 1), (2, 1), (3, 1) . . . are arranged in the thickness direction, and the sub-conductors (1, 1), (1, 2), (1, 3) . . . are arranged in the width direction.

Figure 6:
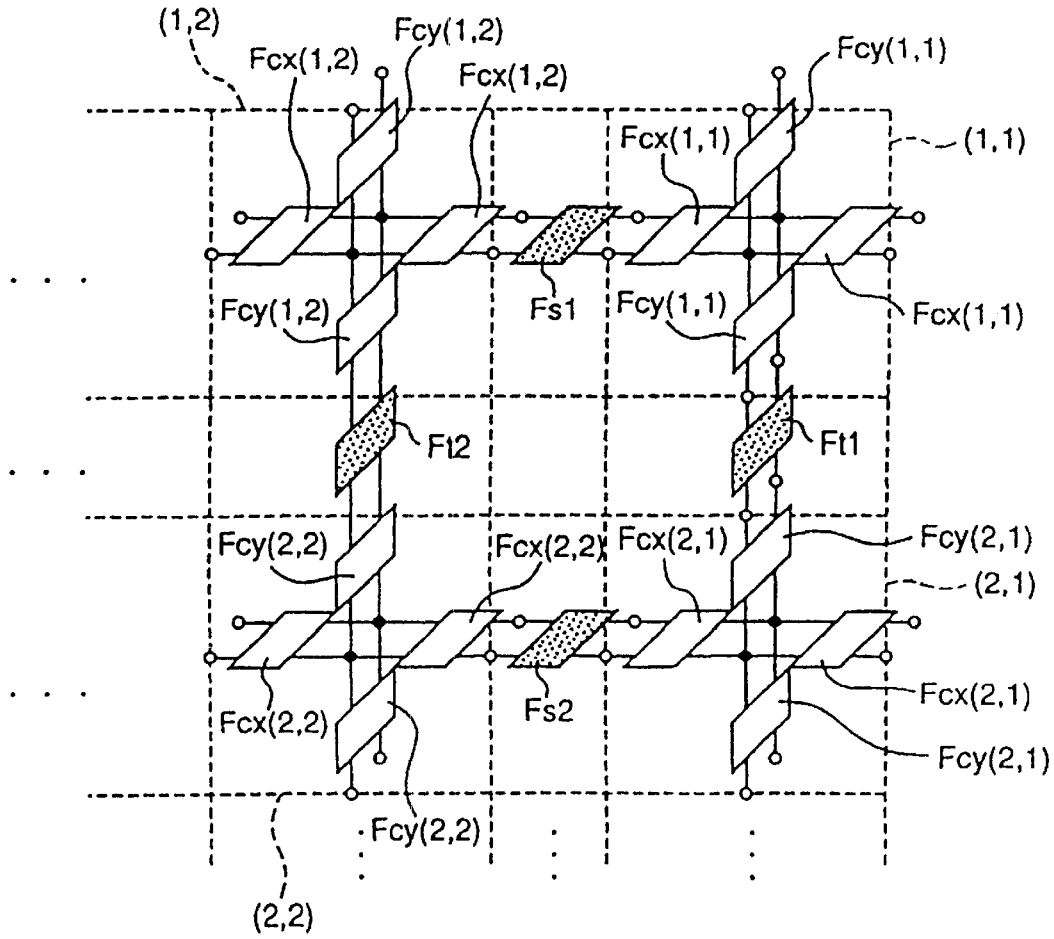
FIG. 6 is a two-dimensional equivalent circuit diagram of the multi-layer multi-line model of FIG. 5C.

The two-dimensional equivalent circuit as shown by the multi-layer multi-line model in FIG. 5C can be expressed as in FIG. 6. In FIG. 6, Fcx represents the cascade connection matrix of the conductors in the width direction thereof, and Fcy the cascade connection matrix of the conductors in the thickness direction thereof. The codes (1, 1), (1, 2) . . . , which correspond to the respective sub-lines, are appended to Fcx and Fcy.

The respective cascade connection matrices Fcx, Fcy, Ft, and Fs are expressed by the following formulae 10 through 13. Ft represents the cascade connection matrix of the dielectric layers in the respective lines. The dielectric layers are numbered sequentially from the uppermost layer. Fs represents the cascade connection matrix of the adjacent conductor lines in the width direction, and numbered sequentially from the outside. In the formulae 10 through 13, L and g represent the width and the thickness of each sub-conductor, and S the width of the sub-dielectric between adjacent sub-conductors. Accordingly, the cascade connection matrixes Fcx, Fcy, Ft, and Fs correspond to the widths and the thicknesses of the respective sub-conductors, and the widths of the respective sub-dielectrics. In this case, Zs represents the surface (characteristic) impedance of each conductor, and is expressed by $Zs=(1+j)\sqrt{\{(\omega\mu_0)/(2\sigma)\}}$.

$$F_{cx}=\begin{pmatrix} \cosh\left(\frac{1+j}{\delta}\cdot\frac{L}{2}\right) & Zs\sinh\left(\frac{1+j}{\delta}\cdot\frac{L}{2}\right) \\ \frac{1}{Zs}\sinh\left(\frac{1+j}{\delta}\cdot\frac{L}{2}\right) & \cosh\left(\frac{1+j}{\delta}\cdot\frac{L}{2}\right) \end{pmatrix}$$

$$F_{cy}=\begin{pmatrix} \cosh\left(\frac{1+j}{\delta}\cdot\frac{g}{2}\right) & Zs\sinh\left(\frac{1+j}{\delta}\cdot\frac{g}{2}\right) \\ \frac{1}{Zs}\sinh\left(\frac{1+j}{\delta}\cdot\frac{g}{2}\right) & \cosh\left(\frac{1+j}{\delta}\cdot\frac{g}{2}\right) \end{pmatrix}$$

$$F_t=\begin{pmatrix} 1 & j\omega\mu_0 t\left(1-\frac{\varepsilon_m}{\varepsilon_t}\right) \\ 0 & 1 \end{pmatrix}$$

$$F_t=\begin{pmatrix} 1 & j\omega\mu_0 S\left(1-\frac{\varepsilon_m}{\varepsilon_s}\right) \\ 0 & 1 \end{pmatrix}$$

Accordingly, theoretically, the line width L and the thickness g of the respective sub-conductors, and the width S and the thickness t of the respective sub-dielectrics may be set so that the real part (resistance component) of the surface impedance of the respective sub-conductors is minimum, by operating the connection matrixes based on the two-dimensional equivalent circuit of FIG. 6.

However, it is difficult to determine analytically the line width L and the thickness g of the respective sub-conductors, and the width S and the thickness t of the respective sub-dielectrics based on the two-dimensional equivalent circuit of FIG. 6 and in the above-described conditions.

However, the inventors, by using the equivalent circuit of FIG. 7A which is the one-dimensional model in the width direction of the equivalent circuit of FIG. 6, have obtained the recurrence formula (mathematical formula 14) on the condition that the real part (resistance component) of the surface impedance of the respective sub-conductors is minimum. The line width L of the respective sub-conductors and the width S of the respective sub-dielectrics are set based on the parameter b satisfying the recurrence formula and the formulae 15 and 16. The equivalent circuit of FIG. 7A is the one-dimensional model in which the equivalent circuit of FIG. 6 is taken as a single layer, and the thickness direction of the single layer is not considered.

$$b_{k+1}=\tan h^{-1}(\tan b_k) \quad \text{[mathematical formula 14]}$$

$$L_{k+1}=L_k(b_{k+1}/b_k) \quad \text{[mathematical formula 15]}$$

$$S_{k+1}=S_k(b_{k+1}/b_k) \quad \text{[mathematical formula 16]}$$

As described above, the line-width L of the respective sub-conductors and the width S of the respective sub-dielectrics were set, and the conductor loss at a high frequency was evaluated by a finite element method. It has been determined that the loss can be reduced as compared with the case where the line-width L of the respective sub-conductors and the width S of the respective sub-dielectrics are set at equal values, respectively. When the line-width L of the respective sub-conductors and the width S of the respective sub-dielectrics are set, it is necessary to give the initial values of $b_1$, $L_1$, and $S_1$ previously. In this invention, it is preferable that the initial values are set so that the electric current phases of the respective current densities are in the range of ±90° or ±45°. As a result of the analysis using the one-dimensional model of FIG. 7A, a satisfactory relationship is derived between L1 and S1 to which initial values are to be given, in order to minimize the surface resistance. The initial values are given to L1 and S1 so as to satisfy the relationship, so that currents substantially in phase flow through the respective sub-conductors. That is, by the examination from the circuit theoretical standpoint, it is concluded that the preferable condition which the widths of the respective dielectrics are to satisfy is "the widths of the sub-dielectrics are set so that the changed current density phases in the sub-conductors on the current-approaching side are cancelled out". Thus, the same results as the conditions described above under "Currents and Phases in Respective Sub-conductors" can be obtained.

Further, by the inventors, the line-width L of the respective sub-conductors and the width S of the respective sub-dielectrics are set by using, instead of the formula 14, the following mathematical formulae 17 and 18 which are decreasing functions analogous to the recurrence formula of the mathematical formula 14. The conductor loss at a high frequency was evaluated by the finite element method. As a result, it has been determined that in the above-described manner, the loss can be reduced as compared with the case where the line-widths of the sub-conductors and also, the widths S of the sub-dielectrics are set at the same values, correspondingly.

$$b_{k+1}=\tan h^{-1}b_k \quad \text{[mathematical formula 17]}$$

$$b_{k+1}=\tan b_k \quad \text{[mathematical formula 18]}$$

The results obtained by use of the respective formulae 14, 17, and 18 become different when the initial values are given differently. Thus, a skilled person can decide which formula is most appropriate, but the results are not always optimal.

That is, the recurrence formula of the formula 14 is determined by use of the one-dimensional model, and does not necessarily give an optimum result when it is applied to the two dimensional model. Practically, inside the sub-conductors, the width direction and the thickness direction are influenced by each other, so that the propagation vector includes angular information. However, the angular information is not considered by the equivalent circuit of FIG. 6. Accordingly, the formulae 14, 17, and 18 have no essential physical meanings, and play a role like a trial function in the two-dimensional model. Thus, after the effectiveness of the results obtained by use of these trial functions are confirmed by use of the finite element method, the final line-widths are set.

However, from the above-described circuit theoretical discussion, it follows that the overall conductor loss at a high frequency can be reduced by setting the width of a sub-line positioned nearer to the outside at a smaller value. Also, from the same discussion as described above, it follows that when the single layer, multi-line structure is employed, the overall conductor loss can be reduced by setting the thickness of a sub-line positioned nearer to the outside at a smaller value.

Hereinafter, the thicknesses of the thin-film conductors of each sub-conductor and the thicknesses of the thin-film dielectrics will be described. In the sub-conductor having a multi-layer structure, currents can be effectively dispersed in the respective thin-film conductors by setting the film-thicknesses of the respective thin-film dielectrics so that currents substantially in phase flow through the respective thin-film conductors. Consequently, the skin effect of the sub-conductor at a high frequency can be inhibited. In this case, in order that a high frequency current flows through each thin-film conductor, it is more preferable that the thickness of each thin-film conductor is not more than the skin depth δ in consideration of the skin effect. This is because substantially no currents flow in the part of the electrode deeper than the skin depth δ, even if the thin-films are thicker than the skin depth δ.

Moreover, as a result of the examination of the equivalent circuit of FIG. 7B which is a one-dimensional model in the thickness direction of the equivalent circuit of FIG. 6, it is more preferable that the thicknesses of each thin-film conductor and each thin-film dielectric are set as follows. That is, by use of the equivalent circuit of FIG. 7B and the conditions that the real part (resistance component) of the surface impedance of the sub-conductor is minimum, the recurrence formula represented by the formula 19 is obtained. Based on a parameter b satisfying the recurrence formula, and the formulae 20 and 21, the thickness g of each sub-conductor and the thickness X of each thin-film dielectric are set. In this case, the equivalent circuit of FIG. 7B is a one-dimensional model obtained from the viewpoint of one sub-conductor in the equivalent circuit of FIG. 6, disregarding the width direction in the equivalent circuit of FIG.

$$a_{k+1}=\tan h^{-1}(\tan a_k) \quad \text{[mathematical formula 19]}$$

$$g_{k+1}=g_k(a_{k+1}/a_k) \quad \text{[mathematical formula 20]}$$

$$X_{k+1}=X_k(a_{k+1}/a_k) \quad \text{[mathematical formula 21]}$$

The thickness g of each sub-conductor and the thickness X of each thin-film dielectric were set as described above, and the conductor loss at a high frequency was evaluated by a finite element method. It has been determined that the loss can be further reduced as compared with the case where the thickness g of each sub-conductor and the thickness X of each thin-film dielectric are separately set to be the same, correspondingly. It is necessary to give initial values to a1, g1, and X1 when the thickness g of each sub-conductor and the thickness X of each thin-film dielectric are set.

As a result of the analysis using the one-dimensional model of FIG. 7B, it is preferable that to minimize the surface resistance of a sub-conductor, a satisfactory relationship is derived between $g_1$ and $X_1$ to which the initial values are given, and $g_1$ and $X_1$ are given so as to satisfy the relationship. The more preferable conditions which the thickness of each thin-film conductor is to satisfy are that "the thin-film conductors of a sub-conductor are formed so that a thin-film conductor thereof lying at a position further inside is thicker".

Further, by the inventors, the thicknesses g of the thin-film conductors and the thicknesses X of the thin-film dielectrics are set by using, instead of the formula 19, the following formulae 22 and 23 which are decreasing functions analogous to the recurrence formula of the formula 19. The conductor loss at a high frequency was evaluated by the finite element method. As a result, it has been determined that in the above-described manner, the loss can be reduced as compared with the case where the thicknesses g of the thin-film conductors and the thicknesses X of the thin-film dielectrics are set to be equal, correspondingly.

$$a_{k+1}=\tan h^{-1}a_k \quad \text{[mathematical formula 22]}$$

$$a_{k+1}=\tan a_k \quad \text{[mathematical formula 23]}$$

The results obtained by use of the formulae 19, 22, and 23 are different with initial values given differently. Accordingly, a skilled person can decide which formula is most appropriate, but the results are not always optimal.

That is, the recurrence formula of the mathematical formula 19 is determined by use of the one-dimensional model, and does not necessarily give an optimum result when the two-dimensional model is used. Further, practically, inside of each sub-conductor, mutual action occurs in the width and thickness directions, so that the propagation vector includes angular information. However, the equivalent circuit of FIG. 6 is given not considering the angular information. Accordingly, in the two-dimensional model, the formulae 19, 22, and 23 have no essential physical meanings, and play a role like a trial function. Thus, the effectiveness of the results obtained by use of these trial functions are confirmed by the finite element method or the like, and the final thicknesses of the thin-film conductors and the thicknesses of the thin-film dielectrics are set.

As seen in the above description, from the circuit theoretical discussion, it is understood that in a sub-conductor having a multi-layer structure, the whole conductor loss at a high frequency in the sub-conductor can be further reduced by setting so that a thin-film conductor thereof lying at a position further inside has a larger thickness, as compared with the case where the thicknesses of the thin-film conductors are set at the same value.

The widths of the sub-conductors and those of the sub-dielectrics are set based on the above-described principle. The results simulated by the finite element method will be described below.

Figure 8:
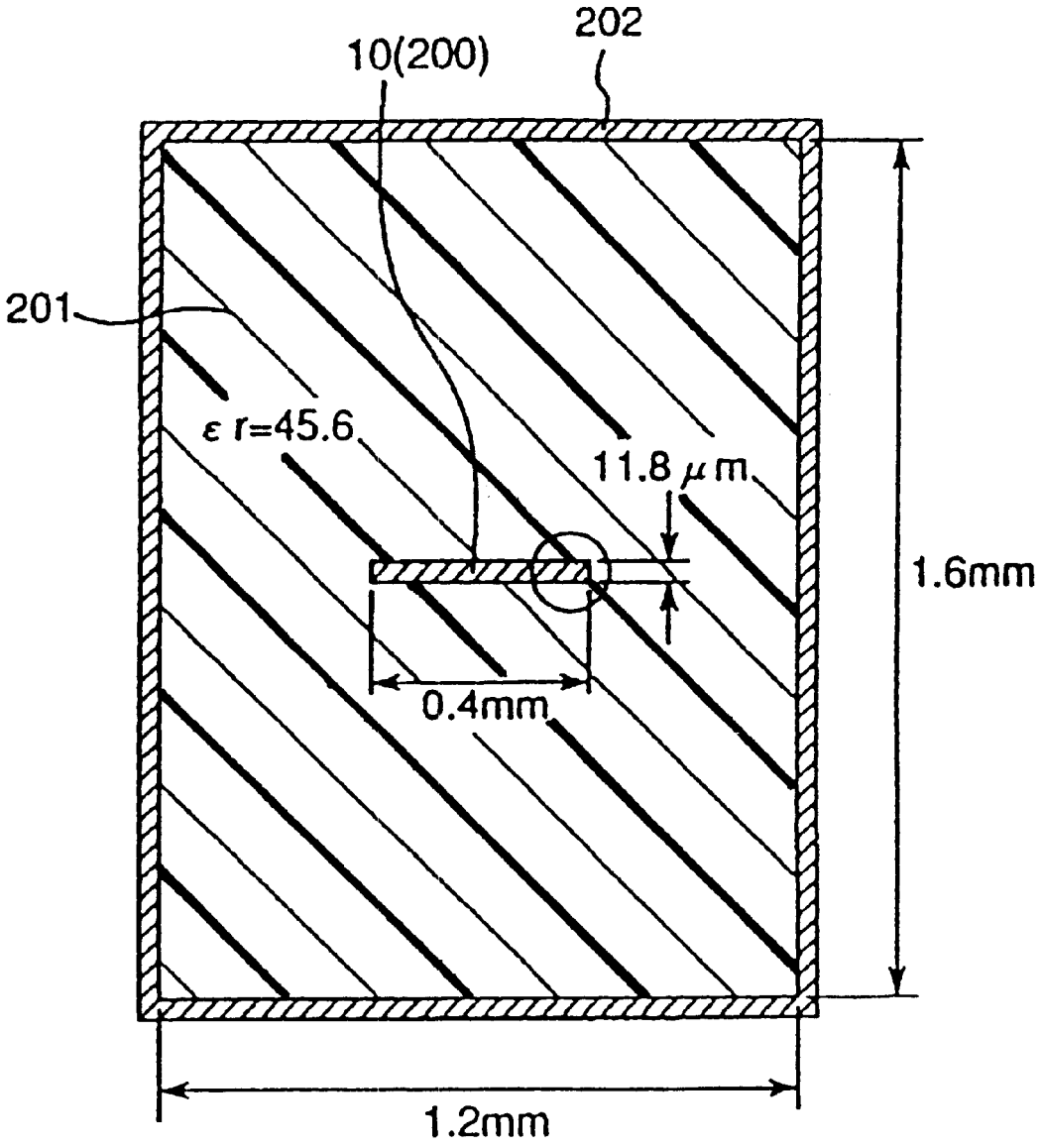
FIG. 8 is a cross-sectional view of a triplet type strip line model used in the simulation of the multi-line structure electrode according to the present invention.

Each simulation described below was carried out by use of a model provided by filling a dielectric 201 with a relative dielectric constant of $\in r=45.6$ into the complete conductor cavity 202 as shown in FIG. 8, and disposing an electrode 10 or 200 in the center of the dielectric 201. The electrode 10 is an electrode according to the present invention having a multi-line structure, while an electrode 200 is conventional one, not having the multi-line structure.

Figure 9A:
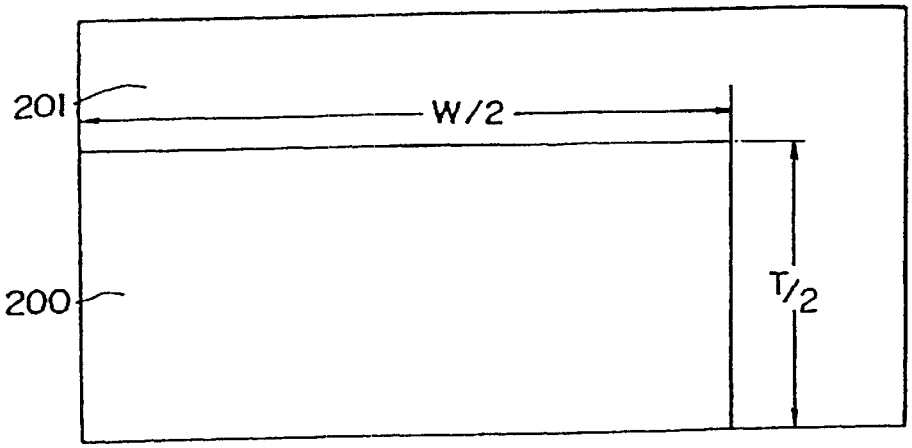
FIG. 9A PRIOR ART
FIG. 9A is a view of a conventional electrode not having a multi-line structure used in the simulation.
Figure 9B:
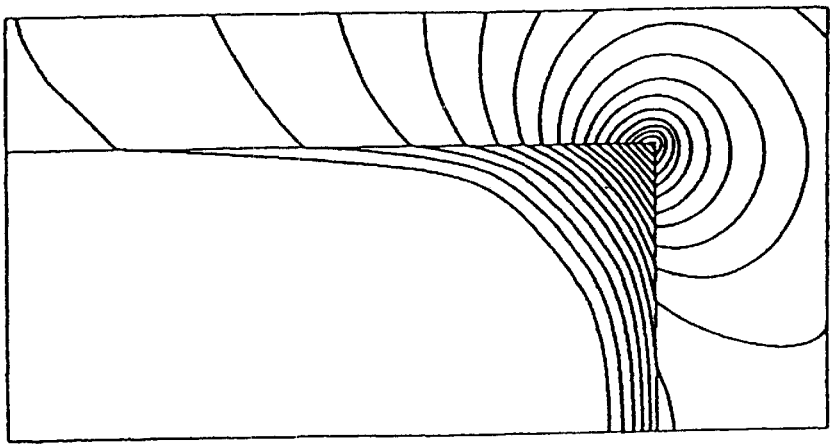
FIG. 9B PRIOR ART
FIG. 9B illustrates the simulation results of the electric field distribution.
Figure 9C:
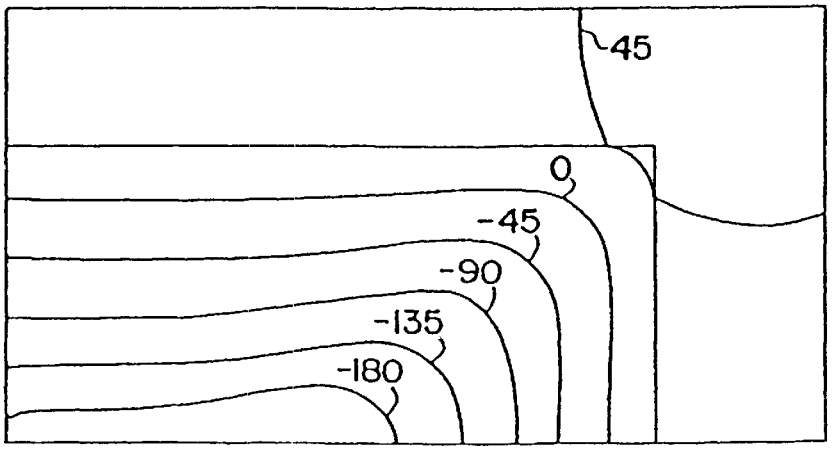
FIG. 9C PRIOR ART
FIG. 9C illustrates the simulation results of the phase distribution.

FIG. 9 shows the electric field distribution and the phase of the electrode 200 as a conventional example not having the multi-line structure. The simulation was carried out by use of the model in which the cross-section is one fourth of that of the electrode 200 as shown in FIG. 9A. The overall width W of the electrode 200 was 400 μm, or 0.4 mm, and the thickness T of the electrode 200 was 11.842 μm. As a result of the simulation, it is understood that the electric field is concentrated at the end of the electrode as shown in FIG. 9B, and the phase of the electric field is more decreased at a position further inside the electrode 200. The results of the simulation at 2 GHz are as follows.

(1) attenuation constant α: 0.79179 Np/m, (2) phase constant β: 283.727 rad/m, (3) conductor Qc (=β/2α); 179.129

Figure 10:
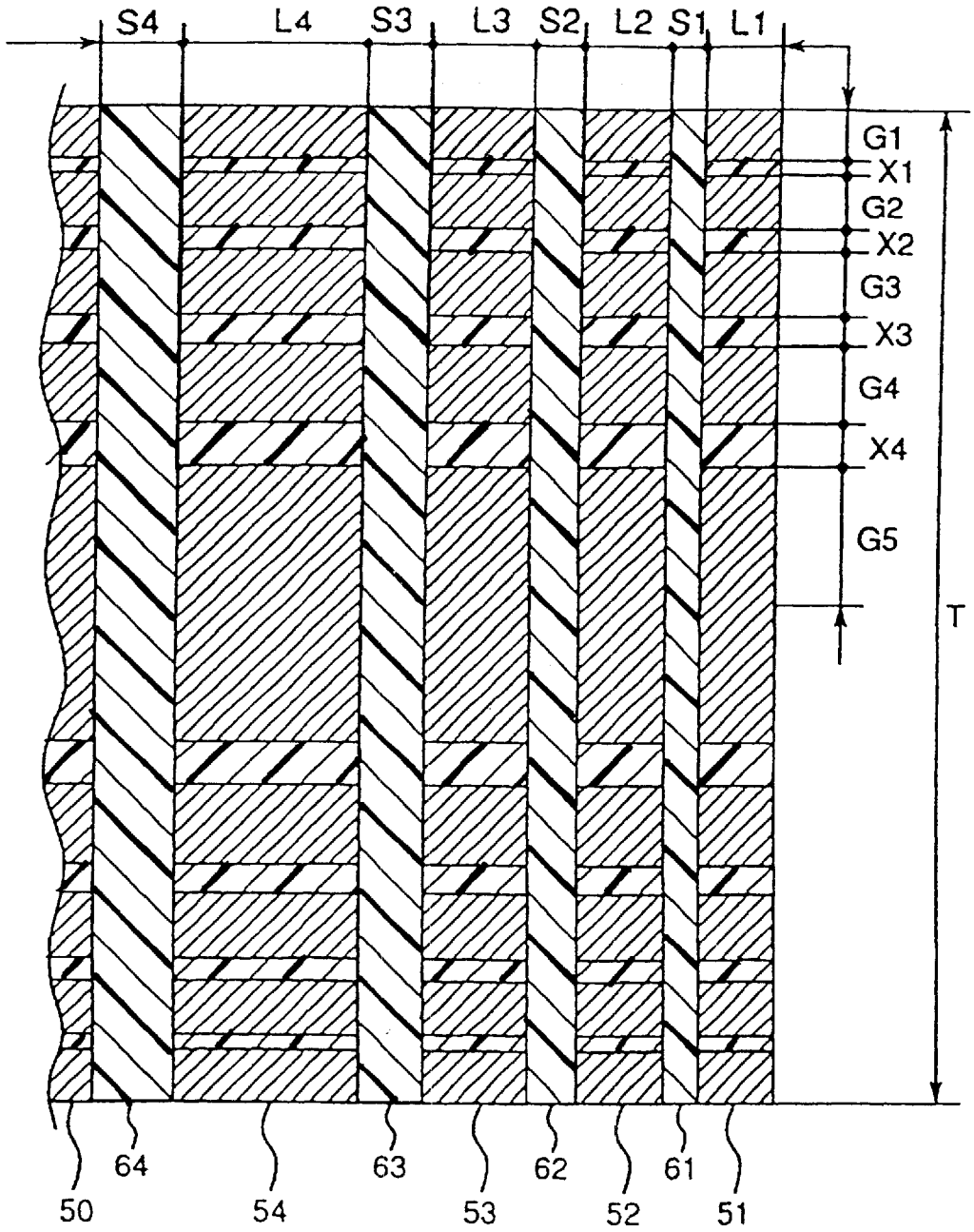
FIG. 10 illustrates an electrode having a multi-line structure according to the present invention used in the simulation.

On the other hand, the simulation results at 2 GHz of the high frequency low loss electrode according to the present invention, having a multi-line multi-layer structure as shown in FIG. 10 are as follows.

(1) attenuation constant α: 0.46884 Np/m, (2) phase constant β: 283.123 rad/m, (3) conductor Qc (=β/2α); 301.940

In this case, the conductor line widths L1, L2, L3, and L4 of the sub-conductors 51, 52, 53, and 54 were set at 1.000 μm, 1.166 μm, 1.466 μm, and 2.405 μm, respectively.

The dielectric line widths S1, S2, S3, and S4 of the dielectrics 61, 62, 63, and 64 were set at 0.3 μm, 0.35 μm, 0.44 μm, and 0.721 μm, respectively.

The thicknesses G1, G2, G3, G4, and G5 of the thin-film conductors were set at 0.6 μm, 0.676 μm, 0.793 μm, 1.010 μm, and 1.816 μm, respectively.

The thicknesses X1, X2, X3, and X4 of the thin-film dielectrics were set at 0.2 μm, 0.225 μm, 0.264 μm, and 0.337 μm.

In this case, as shown in FIG. 10, the above thickness G5 represents half of the thickness of the thin-film conductor positioned at the center of the sub-conductors. The overall thickness of the sub-conductors was taken as 11.842 μm.

In the above simulation, the conductivity σ of the conductor was 52.9 MS/m, and the dielectric constants of the dielectric lines and the thin-film dielectrics were 10.0, respectively, and were used in the calculation.

Figure 11A:
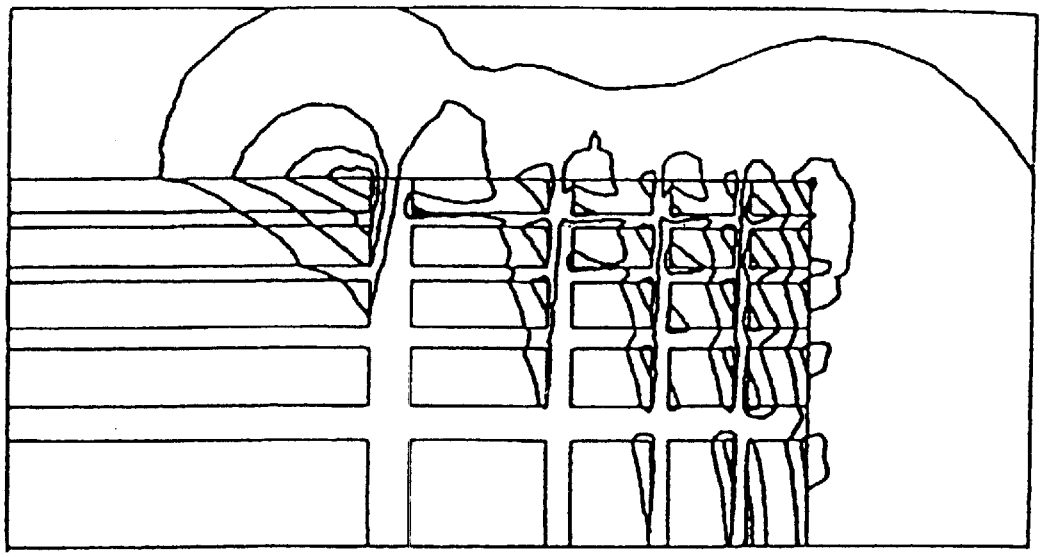
FIG. 11A illustrates the simulation results of an electric field distribution in the electrode of FIG. 10.
Figure 11B:
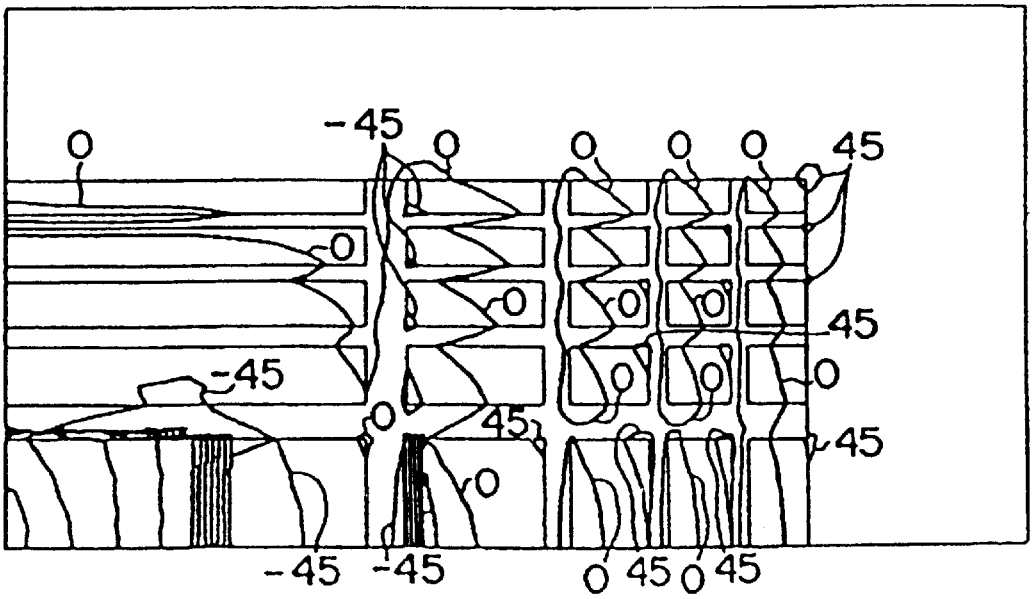
FIG. 11B illustrates the simulation results of a phase distribution in the electrode of FIG. 10.

Further, it is seen that in the electrode according to the present invention having a multi-line multi-layer structure, the electric field is dispersed and distributed in the respective ends of the thin-film conductors as shown in FIG. 11A. Further, as shown in FIG. 11B, the phases of the electric fields are distributed in the respective thin-film conductors so that the electric fields are substantially in phase in the respective thin-film conductors.

From the above-described discussion, the requirements which the high frequency low loss electrode 1 of this embodiment is to satisfy are as follows.

Requirements for Low Loss at High Frequency (i) The line-width of each sub-conductor is set so that the change-width (2θ) of the current density phase is small. Concretely, preferably, the phase angle is set at θ≦90°, and more preferably, at θ≦45°.

(ii) The sub-conductors are formed so that the width of a sub-conductor thereof positioned nearer to the outside is smaller.

(iii) The sub-conductors are formed so that the thickness of a sub-conductor thereof positioned nearer to the outside is smaller.

(iv) The widths of the sub-dielectrics are set so that the changed current density phases in the sub-conductors lying on the current-approaching side is cancelled out, respectively. That is, the widths of the sub-dielectrics are set so that the currents flowing in the respective sub-conductors are substantially in phase.

(v) The film thicknesses of the respective dielectric thin films are set so that currents substantially in phase flow through the respective thin-film conductors.

(vi) The thicknesses of the respective thin-film conductors are set at a value which is up to the skin depth δ.

(vii) The thicknesses of the respective thin-film conductors are set so that a thin-film conductor thereof lying at a position further inside position is thicker.

As seen in the above description, in the high frequency low loss electrode 1 of the present invention, the sub-conductors 21, 22, and 23, and also, the sub-dielectrics 31, 32, and 33 are so formed that a sub-conductor thereof and a sub-dielectric thereof lying at a position more distant from the main conductor 20 have a smaller width, correspondingly. The respective sub-conductors 21, 22, and 23 are formed to have a width which is up to $\pi/2$ times the skin depth δ at an applied frequency. Moreover, the widths of the respective sub-dielectrics 31, 32, and 33 are set so that the currents flowing in the respective sub-conductors 21, 22, and 23 are substantially in phase. Accordingly, currents in the dispersion state can flow through the respective sub-conductors 21, 22, and 23, so that the conductor loss in the end portions can be reduced. In the high frequency low loss electrode of this embodiment, each sub-conductor has the multi-layer structure in which the thin-film conductors and the thin-film dielectrics are laminated alternately, the film thicknesses of the respective thin-film dielectrics are set so that currents substantially in phase flow through the respective thin-film conductors, the film-thicknesses of the respective thin-film conductors are smaller than the skin depth δ and are set so that the thickness of a thin-film conductor thereof lying at a position further inside is larger. Consequently, currents can be dispersed in the portions of the respective thin-film conductors which are shallower as compared with the skin depth, and the conductor loss of all the sub-conductors can be further reduced. Thus, the conductor loss in the end portions can be much reduced. In the high frequency low loss electrode of this embodiment, the conductor loss at a high frequency can be remarkably reduced as compared with the conventional electrode.

In the above embodiment, as a preferred form of the present invention, the high frequency low loss electrode 1 satisfying the requirements (i), (ii), (iv), (v), (vi), and (vii) for reduction of the loss under the above-described high frequency condition is described. However, it is not necessary for all of these requirements to be satisfied at the same time. According to the present invention, a variety of modifications, each satisfying at least one of the above-described seven requirements, are possible. In the modification examples described below, the conductor loss in the end portions at a high frequency can be reduced in comparison to the conventional example.

MODIFICATION EXAMPLE 1

Figure 12:
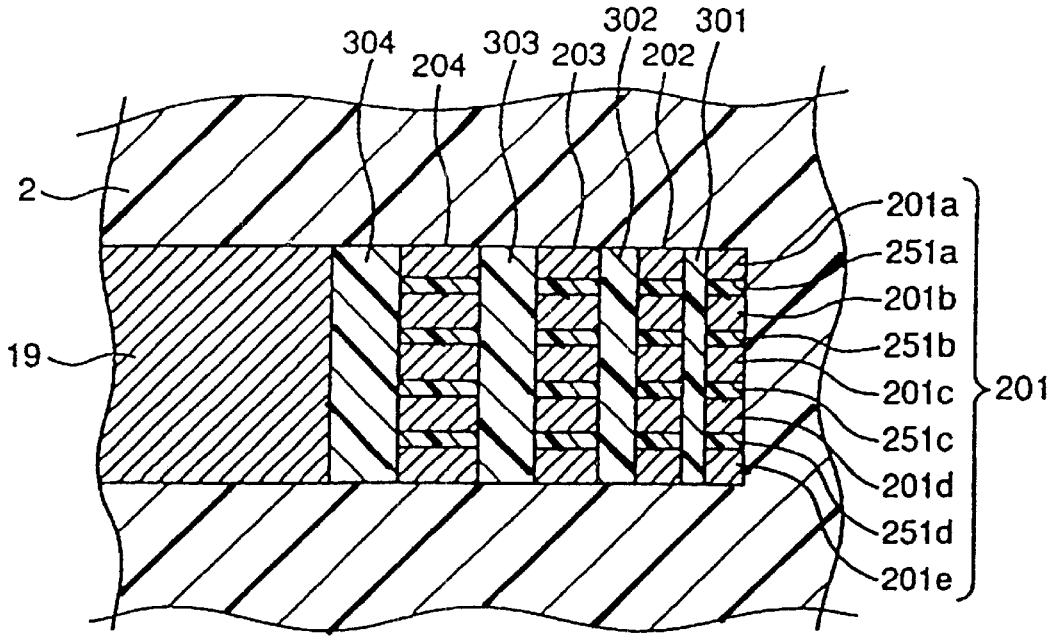
FIG. 12 is a cross-sectional view showing the configuration of a high frequency low loss electrode of a modification example 1.

In a high frequency low loss electrode as a modification example 1, sub-conductors 201, 202, 203, and 204, and sub-dielectrics 301, 302, 303, and 304 are alternately disposed in the electrode end portion, as shown in FIG. 12. In the modification example 1, the sub-conductors 201, 202, 203, and 204 are formed so that the width of a sub-conductor thereof positioned nearer to the outside is smaller. The sub-conductor 201 is formed to have a line width of up to $\pi\delta/2$, and preferably, up to $\pi\delta/4$. The sub-dielectrics 301, 302, 303, and 304 are formed so that the width of a sub-dielectric thereof positioned nearer to the outside is smaller. Each sub-conductor comprises thin-film conductors and thin-film dielectrics laminated alternately. For example, the sub-conductor 201 comprises a thin-film conductor 201*a,* a thin-film dielectric 251*a,* a thin-film conductor 201*b,* a thin-film dielectric 251*b,* a thin-film conductor 201*c,* a thin-film dielectric 251*c,* a thin-film conductor 201*d,* a thin-film dielectric 251*d,* and a thin-film conductor 201*e* are laminated. The sub-conductors 202, 203, and 204 are formed in the same manner as described above. In this modification example 1, the respective thin-film conductors are formed to have the same thickness, and the respective thin-film dielectrics are set at the same thickness. Further, in this modification example 1, a main conductor 19 is formed as a single layer. In the high frequency low loss electrode of the modification example 1 configured as described above, the conductor loss at a high frequency in the end portion can be reduced as compared with the conventional electrode.

MODIFICATION EXAMPLE 2

Figure 13:
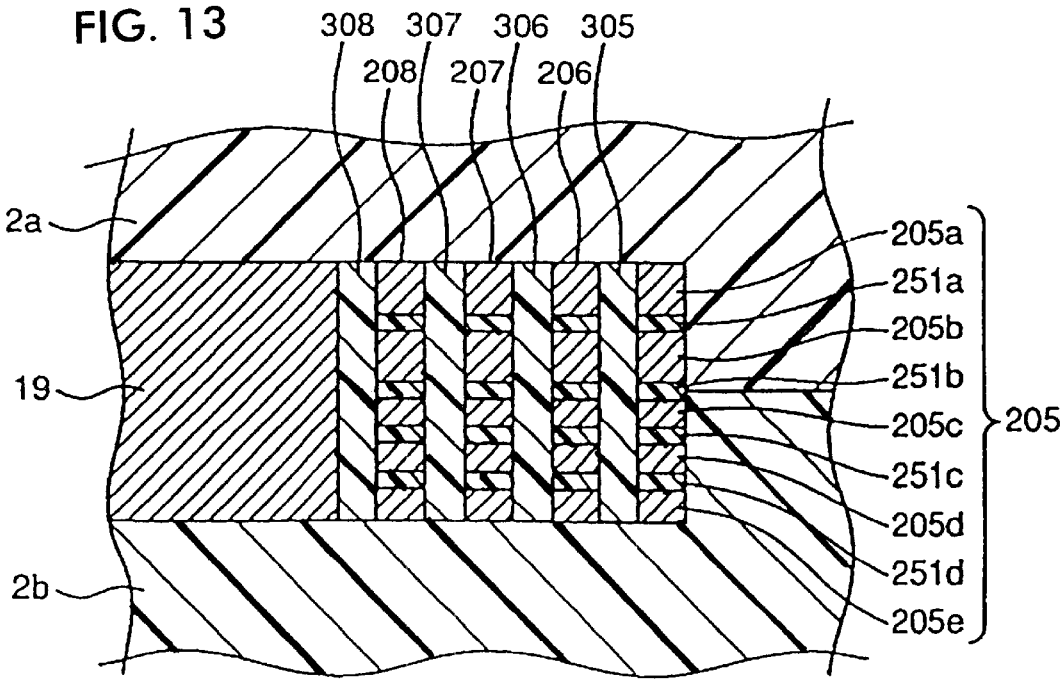
FIG. 13 is a cross-sectional view showing the configuration of a high frequency low loss electrode of a modification example 2.

In a high frequency low loss electrode a modification example 2, sub-conductors 205, 206, 207, and 208, and sub-dielectrics 305, 306, 307, and 308 are alternately disposed in the electrode end portion, as shown in FIG. 13. In this modification example 2, the sub-conductors 205, 206, 207, and 208 are formed to have a line width of up to $\pi\delta/2$, and preferably, up to $\pi\delta/4$. Further, the sub-dielectrics 305, 306, 307, and 308 are formed to have the same width. Each sub-conductor comprises the thin-film conductors and the thin-film dielectrics laminated alternately. For example, the sub-conductor 205 comprises a thin-film conductor 205*a,* a thin-film dielectric 251*a,* a thin-film conductor 205*b,* a thin-film dielectric 251*b,* a thin-film conductor 205*c,* a thin-film dielectric 251*c,* a thin-film conductor 205*d,* a thin-film dielectric 251*d,* and a thin-film conductor 205*e* laminated alternately. The sub-conductors 202, 203, and 204 are formed in the same manner as described above. In the modification example 2, dielectrics 2*a* and 2*b* surrounding the high frequency low loss electrode have dielectric constants different from each other. The thin-film conductors lying on the dielectric 2*a* side and the thin-film conductors on the dielectric 2*b* side are set to have thicknesses which correspond to the dielectric constants of the dielectrics 2*a* and 2*b,* respectively. In other words, the respective thin-film conductors are formed to have the same thickness in terms of electrical length. In the high frequency low loss electrode of the modification example 2 formed as described above, the conductor loss at a high frequency in the end portion can be reduced as compared with the conventional electrode, as well as that in the modification example 1.

MODIFICATION EXAMPLE 3

Figure 14:
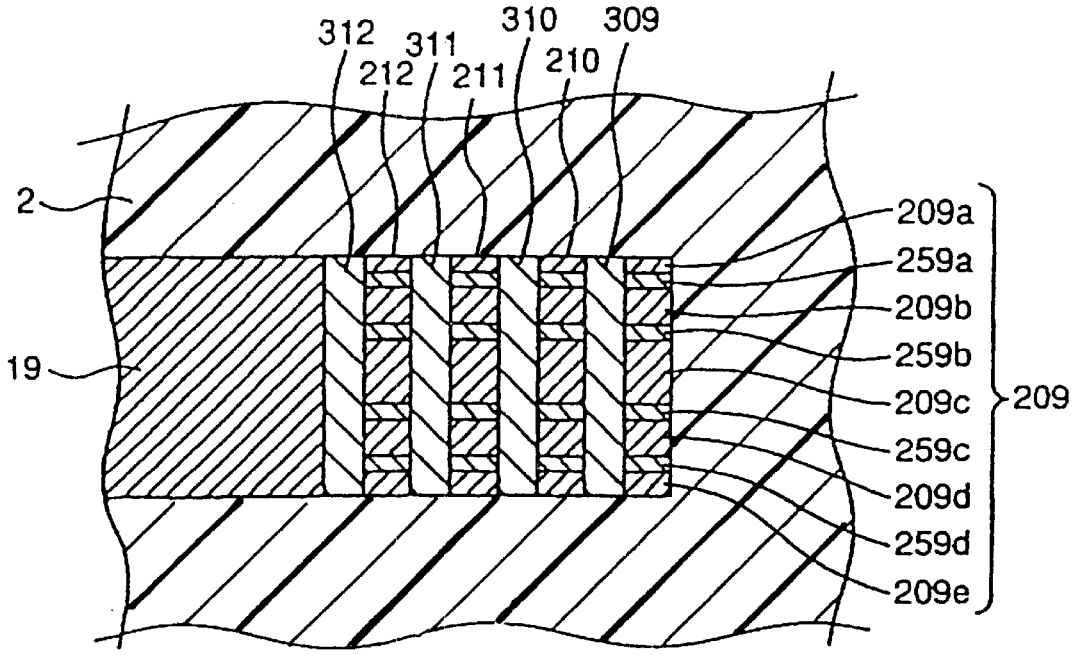
FIG. 14 is a cross-sectional view showing the configuration of a high frequency low loss electrode of a modification example 3.

In a high frequency low loss electrode as a modification example 3, sub-conductors 209, 210, 211, and 212, and sub-dielectrics 309, 310, 311, and 312 are alternately disposed in the electrode end portion, as shown in FIG. 14. In this modification example 3, the sub-conductors 209, 210, 211, and 212 are set to have substantially the same width. Further, in the modification example 3, the sub-conductors 209, 210, 211, and 212 are formed to have, preferably, a line width of up to $\pi\delta/2$, and more preferably, up to $\pi\delta/4$. Further, the sub-dielectrics 309, 310, 311, and 312 are formed to have the same width. Each sub-conductor comprises the thin-film conductors and the thin-film dielectrics laminated alternately. For example, the sub-conductor 209 comprises a thin-film conductor 209*a,* a thin-film dielectric 259*a,* a thin-film conductor 209*b,* a thin-film dielectric 259*b, a* thin-film conductor 209*c,* a thin-film dielectric 259*c,* a thin-film conductor 209*d,* a thin-film dielectric 259*d,* and a thin-film conductor 209*e* laminated together. The sub-conductors 202, 203, and 204 are formed in the same manner as described above. In the modification example 3, in each sub-conductor, the thin-film conductors are formed so that a thin-film conductor thereof lying at a position further inside is thicker. For example, in the sub-conductor 209, the thin-film conductor 209*c* is formed to be thickest, and the thin-film conductors 209*b* and 209*d* are thinner, and the thin-film conductors 209*a* and 209*e* are formed to be the thinnest. In the high frequency low loss electrode of the modification example 3 configured as described above, the conductor loss at a high frequency in the end portion can be reduced as compared with the conventional electrode.

MODIFICATION EXAMPLE 4

Figure 15:
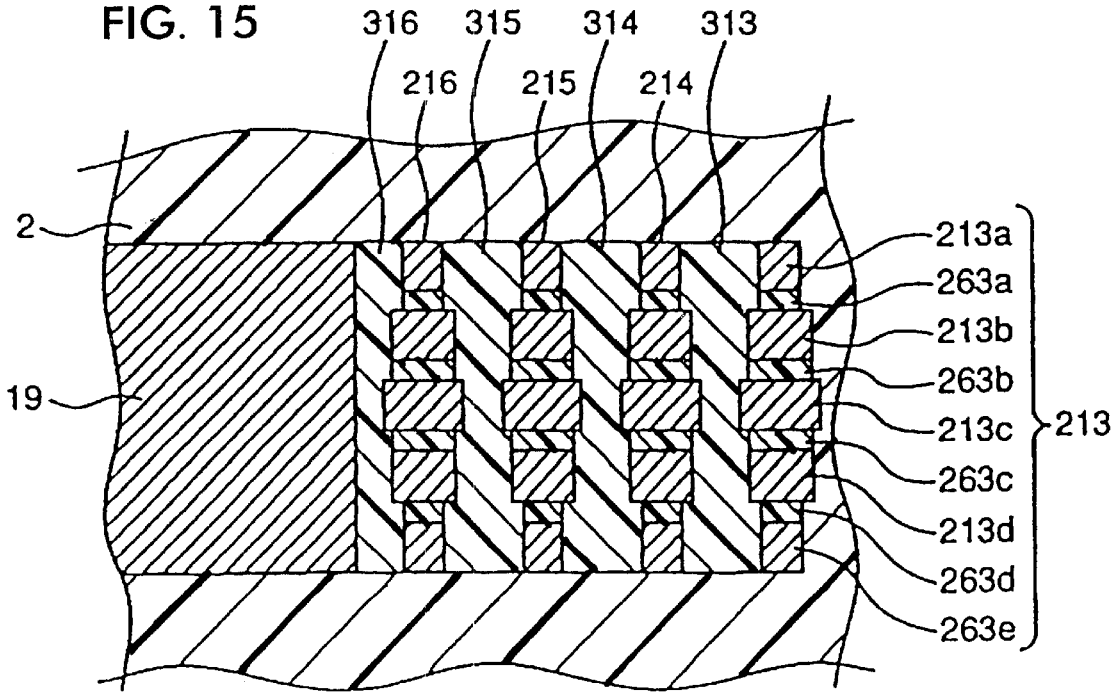
FIG. 15 is a cross-sectional view showing the configuration of a high frequency low loss electrode of a modification example 4.

In a high frequency low loss electrode as a modification example 4, sub-conductors 213, 214, 215, and 216, and sub-dielectrics 313, 314, 315, and 316 are alternately disposed in the electrode end portion, as shown in FIG. 15. In this case, each sub-conductor comprises the thin-film conductors and the thin-film dielectrics laminated alternately. For example, the sub-conductor 213 is formed of a thin-film conductor 213*a,* a thin-film dielectric 263*a,* a thin-film conductor 213*b,* a thin-film dielectric 263*b,* a thin-film conductor 213*c,* a thin-film dielectric 263*c,* a thin-film conductor 213*d,* a thin-film dielectric 263*d,* and a thin-film conductor 263*e* laminated together. The sub-conductors 214, 215, and 216 are formed in the same manner as described above. In the modification example 4, in each sub-conductor, the thin-film conductors are formed so that the width of a thin-film conductor thereof lying at a position further inside is larger. For example, in the sub-conductor 213, the thin-film conductor 213*c* is formed to have a largest width. The thin-film conductors 213*b* and 213*d,* and the thin-film conductors 213*a* and 213*e* are formed to have a smaller width, in that order. In the high frequency low loss electrode of the modification example 4 configured as described above, the conductor loss at a high frequency in the end portion can be reduced as compared with the conventional electrode.

MODIFICATION EXAMPLE 5

Figure 16:
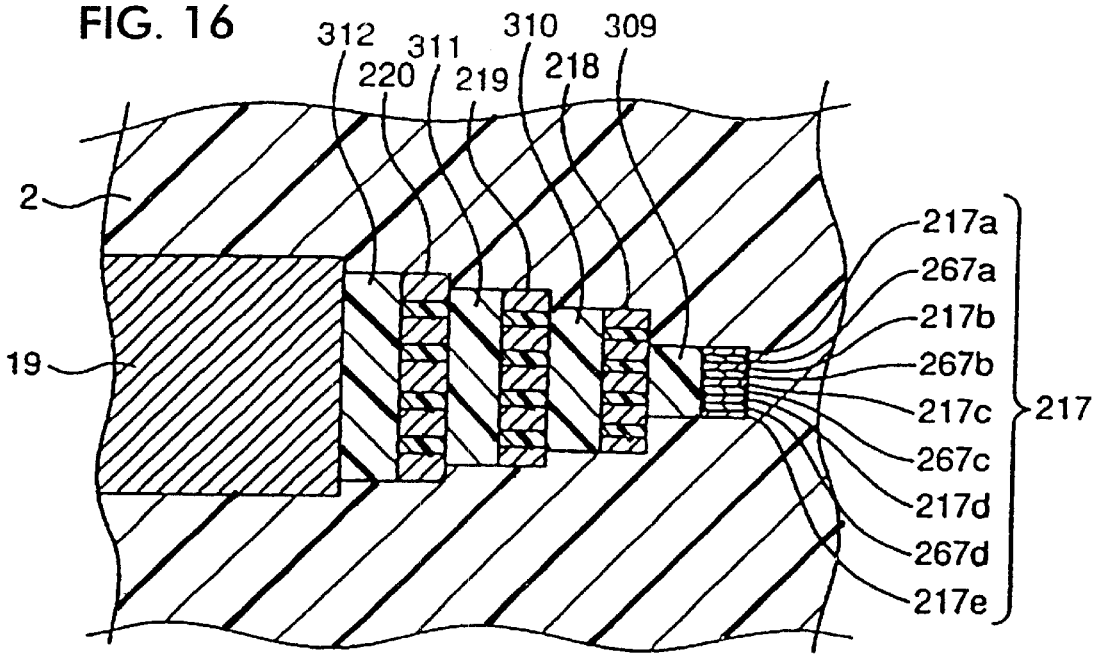
FIG. 16 is a cross-sectional view showing the configuration of a high frequency low loss electrode of a modification example 5.

In the high frequency low loss electrode of the modification example 5, sub-conductors 217, 218, 219, and 220, and sub-dielectrics 309, 310, 311, and 312 are alternately disposed in the electrode end portion, as shown in FIG. 16. In the modification example 5, the sub-conductors 217, 218, 219, and 220 have the same width, and are set so that a sub-conductor thereof positioned nearer to the outside is thinner. In the modification example 5, the line widths of the sub-conductors are preferably up to $\pi\delta/2$, and more preferably, up to $\pi\delta/4$. The sub-dielectrics 309, 310, 311, and 312 are formed to have the same width. Each sub-conductor comprises the thin-film conductors and the thin-film dielectrics laminated alternately. For example, the sub-conductor 217 comprises a thin-film conductor 217*a,* a thin-film dielectric 267*a,* a thin-film conductor 217*b,* a thin-film dielectric 267*b,* a thin-film conductor 217*c,* a thin-film dielectric 267*c,* a thin-film conductor 217*d,* a thin-film dielectric 267*d,* and a thin-film conductor 217*e* laminated together. In this modification example 5, the sub-conductors 218, 219, and 220 each are formed of layers of which the number is equal to that of the sub-conductor 217. However, in a sub-conductor thereof positioned nearer to the main conductor, thicker thin-film conductors and thicker thin-film dielectrics are laminated. In the high frequency low loss electrode of the modification example 5 configured as described above, the conductor loss at a high frequency in the end portion can be reduced as compared with the conventional electrode.

MODIFICATION EXAMPLE 6

Figure 17:
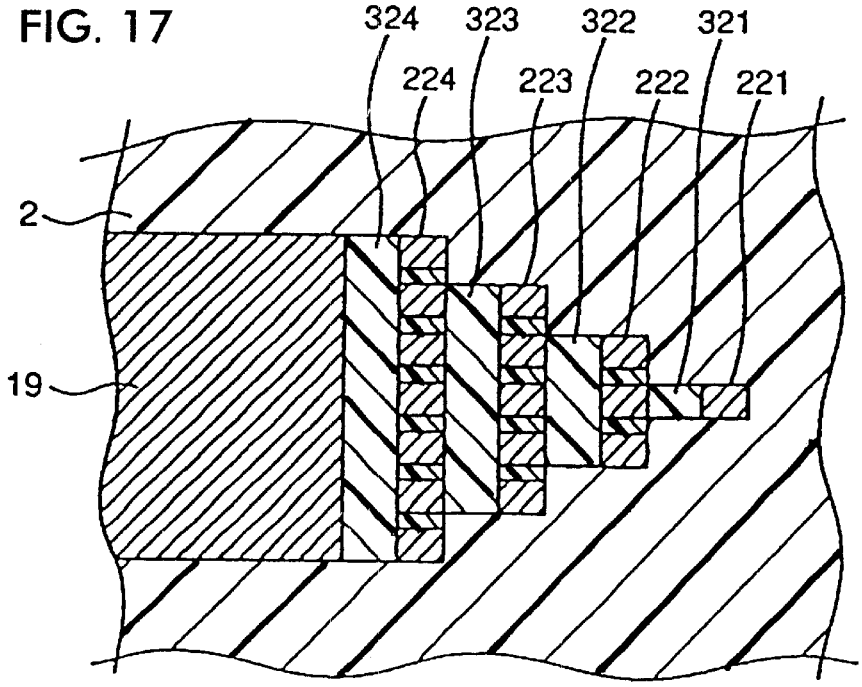
FIG. 17 is a cross-sectional view showing the configuration of a high frequency low loss electrode of a modification example 6.

In a high frequency low loss electrode as a modification example 6, sub-conductors 221, 222, 223, and 224, and sub-dielectrics 321, 322, 323, and 324 are alternately disposed in the electrode end portion, as shown in FIG. 17. In the modification example 6, the sub-conductors 221, 222, 223, and 224 have the same width, and are set so that for a sub-conductor thereof positioned nearer to the outside, the lamination number is smaller, so that the sub-conductor is thinner. In the modification example 6, the line-width of each sub-conductor is preferably up to $\pi\delta/2$, and more preferably up to $\pi\delta/4$. Further, the sub-dielectrics 321, 322, 323, and 324 are formed to have the same width. The outermost sub-conductor 221 has a single layer in this example. However, optionally it may have a multi-layer structure as do the other sub-conductors 222, 223 and 224. In the high frequency low loss electrode of the modification example 6 configured as described above, the conductor loss at a high frequency in the end portion can be reduced as compared with the conventional electrode.

MODIFICATION EXAMPLE 7

Figure 18:
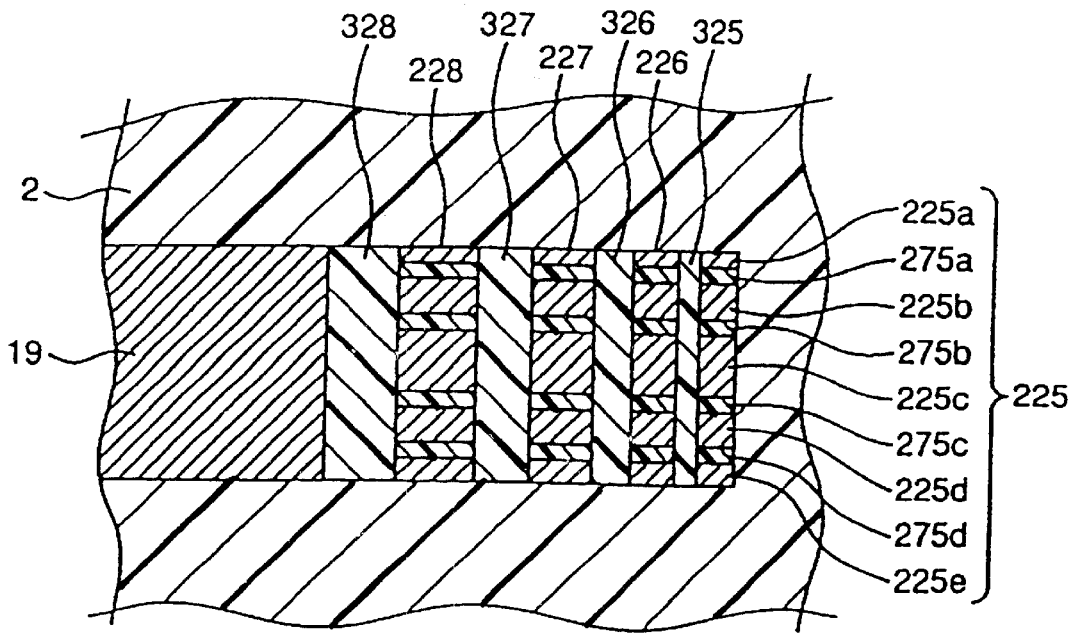
FIG. 18 is a cross-sectional view showing the configuration of a high frequency low loss electrode of a modification example 7.

In a high frequency low loss electrode as a modification example 7, sub-conductors 225, 226, 227, and 228, and sub-dielectrics 325, 326, 327, and 328 are alternately disposed in the electrode end portion, as shown in FIG. 18. In the modification example 7, the sub-conductors 225, 226, 227, and 228 are formed so that the width of a sub-conductor thereof positioned nearer to the outside is smaller. The sub-dielectrics 325, 326, 327, and 328 are formed so that the width of a sub-conductor thereof positioned nearer to the outside is smaller. Each sub-conductor comprises thin-film conductors and the thin-film dielectrics laminated alternately. For example, the sub-conductor 225 comprises a thin-film conductor 225*a,* a thin-film dielectric 275*a,* a thin-film conductor 225*b,* a thin-film dielectric 275*b,* a thin-film conductor 225*c,* a thin-film dielectric 275*c,* a thin-film conductor 225*d,* a thin-film dielectric 275*d,* and a thin-film conductor 225*e* laminated together. The above thin-film conductors are formed so that a thin-film conductor thereof lying at a position further inside is thicker.

In the high frequency low loss electrode of the modification example 7 configured as described above, the conductor loss at a high frequency in the end portion can be reduced as compared with the conventional electrode example.

MODIFICATION EXAMPLE 8

Figure 19:
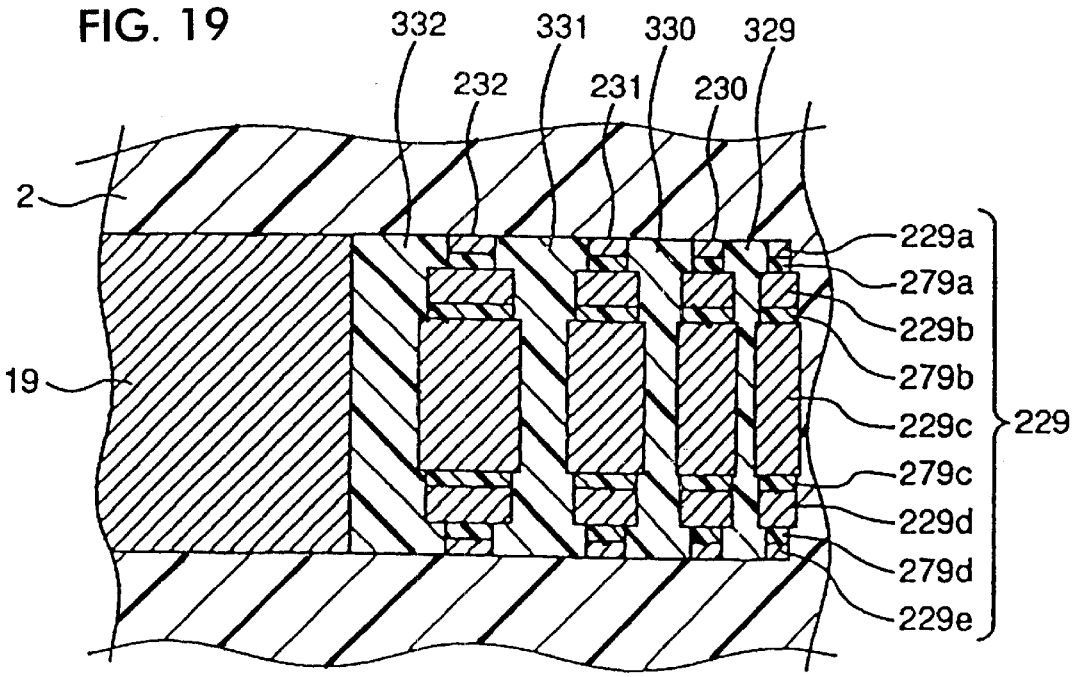
FIG. 19 is a cross-sectional view showing the configuration of a high frequency low loss electrode of a modification example 8.

The high frequency low loss electrode of the modification example 8 comprises sub-conductors 229, 230, 231, and 232, and sub-dielectrics 329, 330, 331, and 332 which are alternately disposed in the electrode end portion, as shown in FIG. 19. In the modification example 8, sub-conductors 229, 230, 231, and 232 are formed so that the width of a sub-conductor thereof positioned nearer to the outside is smaller. Each sub-conductor comprises the thin-film conductors and the thin-film dielectrics laminated alternately.

For example, the sub-conductor 229 comprises a thin-film conductor 229*a,* a thin-film dielectric 279*a,* a thin-film conductor 229*b,* a thin-film dielectric 279*b,* a thin-film conductor 229*c,* a thin-film dielectric 279*c,* a thin-film conductor 229*d,* a thin-film dielectric 279*d,* and a thin-film conductor 229*e* laminated together. The above thin-film conductors are formed so that a thin-film conductor thereof lying at apposition further inside is thicker and wider. Further, in the modification example 8, for each sub-conductor, the thin-film conductors and the thin-film dielectrics are formed so that a thin-film conductor thereof and a thin-film dielectric thereof positioned nearer to the main conductor 19 are wider, respectively. In the high frequency low loss electrode of the modification example 8 configured as described above, the conductor loss at a high frequency in the end portion thereof can be reduced as compared with the conventional electrode.

MODIFICATION EXAMPLE 9

Figure 20:
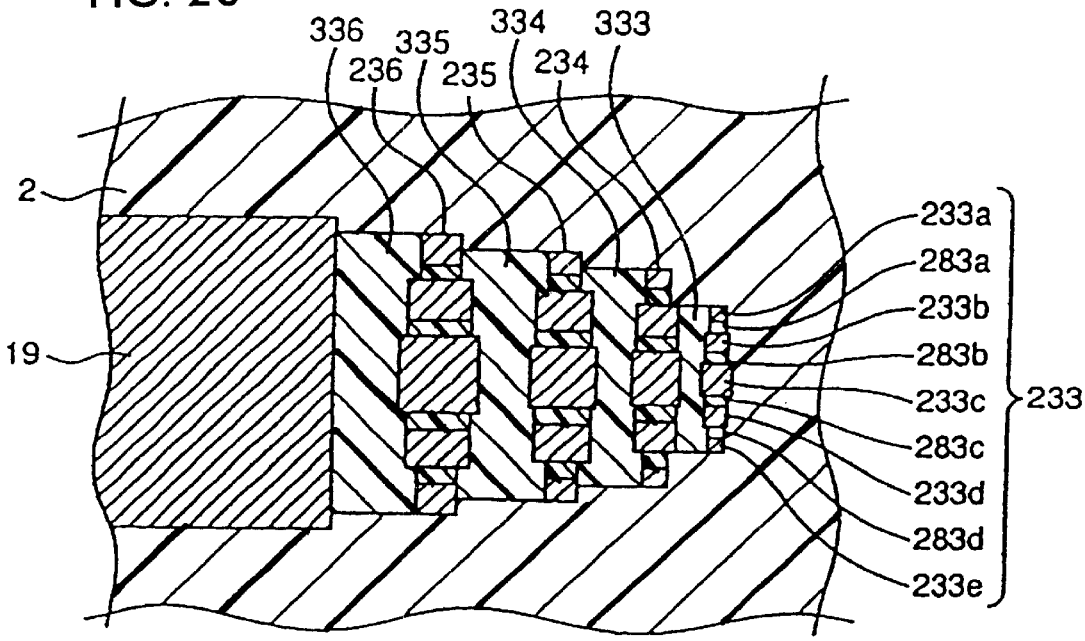
FIG. 20 is a cross-sectional view showing the configuration of a high frequency low loss electrode of a modification example 9.

The high frequency low loss electrode of the modification example 9 comprises sub-conductors 233, 234, 235, and 236, and sub-dielectrics 333, 334, 335, and 336 which are alternately disposed in the electrode end portion, as shown in FIG. 20. In the modification example 9, sub-conductors 233, 234, 235, and 236 are formed so that a sub-conductor thereof positioned nearer to the outside is narrower in width and thinner. Each sub-conductor comprises the thin-film conductors and the thin-film dielectrics laminated alternately. For example, the sub-conductor 233 comprises a thin-film conductor 233*a,* a thin-film dielectric 283*a,* a thin-film conductor 233*b,* a thin-film dielectric 283*b,* a thin-film conductor 233*c,* a thin-film dielectric 283*c,* a thin-film conductor 233*d,* a thin-film dielectric 283*d,* and a thin-film conductor 233*e* laminated together. The above thin-film conductors are formed so that a thin-film conductor thereof lying at a further inside position is thicker and wider. Further, in the modification example 9, in each sub-conductor, the thin-film conductors and the thin-film dielectrics are formed so that a thin-film conductor thereof and a thin-film dielectric thereof positioned nearer to the main conductor 19 are wider, respectively. In the high frequency low loss electrode of the modification example 9 configured as described above, the conductor loss at a high frequency in the end portion thereof can be reduced as compared with a conventional electrode.

MODIFICATION EXAMPLE 10

Figure 21:
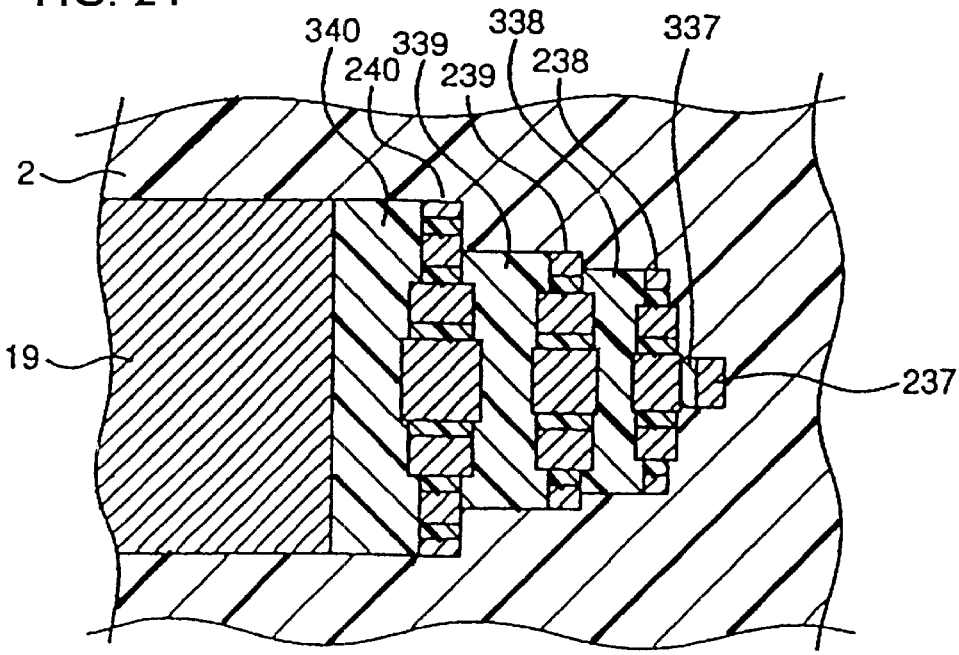
FIG. 21 is a cross-sectional view showing the configuration of a high frequency low loss electrode of a modification example 10.

The high frequency low loss electrode of the modification example 10 comprises sub-conductors 237, 238, 239, and 240, and sub-dielectrics 337, 338, 339, and 340 are alternately disposed in the electrode end portion, as shown in FIG. 21. In the modification example 10, the sub-conductors 237, 238, 239, and 240 are formed so that for a sub-conductor thereof positioned nearer to the outside, the lamination number is smaller. The sub-conductor 237 positioned nearest to the outside is formed of a single layer in this example, although optionally it may also have a multi-layer structure. Further, with respect to the sub-conductors having a lamination structure, the thin-film conductors are formed so that a thin-film conductor thereof lying at a position further inside is thicker and wider. In the high frequency low loss electrode of the modification example 10 configured as described above, the conductor loss at a high frequency in the end portion can be reduced as compared with the conventional electrode.

MODIFICATION EXAMPLE 11

Figure 22:
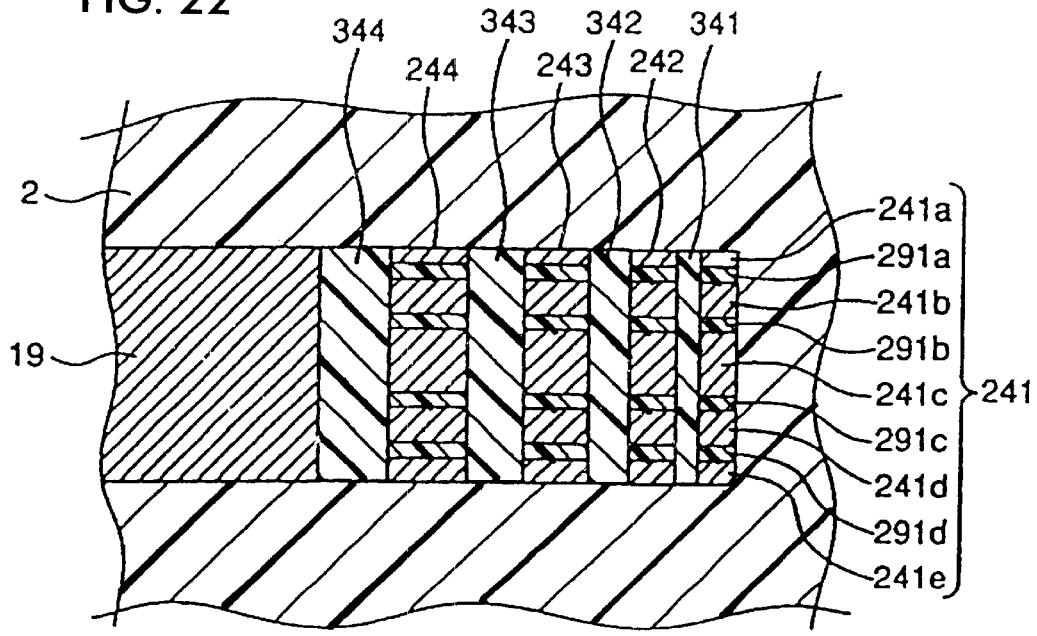
FIG. 22 is a cross-sectional view showing the configuration of a high frequency low loss electrode of a modification example 11.

The high frequency low loss electrode of the modification example 11 comprises sub-conductors 241, 242, 243, and 244, and sub-dielectrics 341, 342, 343, and 344 which are alternately disposed in the electrode end portion, as shown in FIG. 22. In the modification example 11, the sub-conductors 241, 242, 243, and 244 are formed so that a sub-conductor thereof positioned nearer to the outside has a smaller width. The sub-dielectrics 341, 342, 343, and 344 are formed so that a sub-dielectric thereof positioned nearer to the outside has a smaller width. Each sub-conductor comprises thin-film conductors and thin-film dielectrics laminated alternately. For example, the sub-conductor 241 comprises a thin-film conductor 241*a,* a thin-film dielectric 291*a,* a thin-film conductor 241*b,* a thin-film dielectric 291*b,* a thin-film conductor 241*c,* a thin-film dielectric 291*c,* a thin-film conductor 241*d,* a thin-film dielectric 291*d,* and a thin-film conductor 241*e* laminated together. The above thin-film conductors are formed so that a thin-film conductor thereof lying at a position further inside is thicker. Especially, in the modification example 11, the respective dielectric constants of the sub-dielectrics 341 through 344 are lower than that of the dielectric 2 surrounding the sub-dielectrics 341 through 344.

In the high frequency low loss electrode of the modification example 7 configured as described above, the conductor loss at a high frequency in the end portion can be reduced as compared with the conventional electrode, as an example.

MODIFICATION EXAMPLE 12

Figure 23:
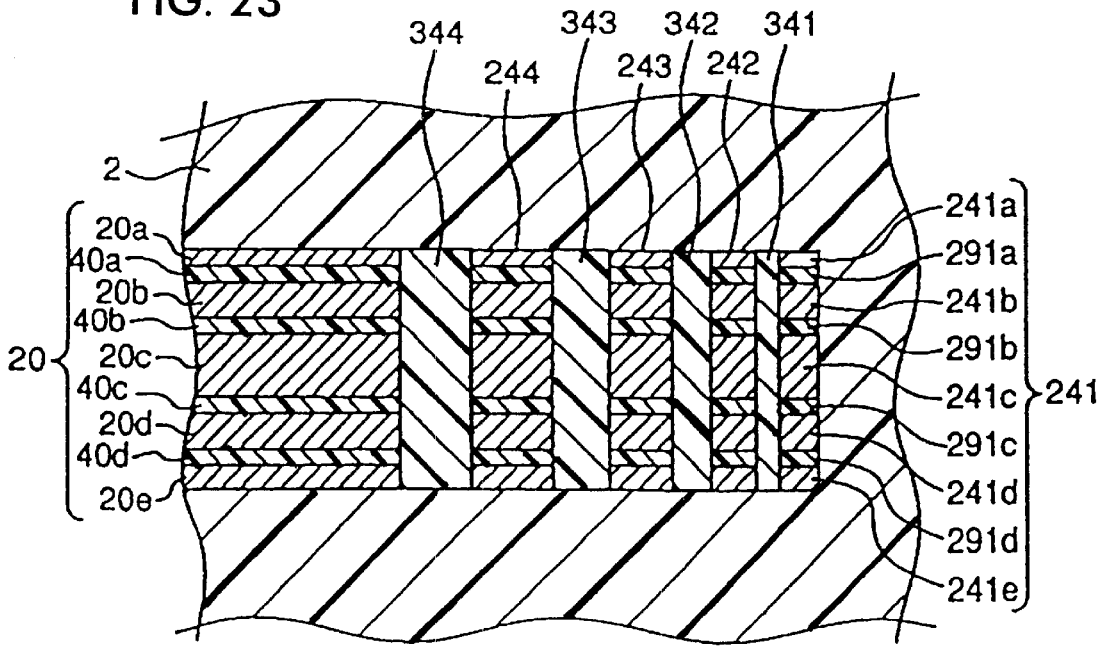
FIG. 23 is a cross-sectional view showing the configuration of a high frequency low loss electrode of a modification example 12.

As shown in FIG. 23, the high frequency low loss electrode of the modification example 12 is configured in the same manner as that of the modification example 11 except that the main conductor 20 has a multi-layer structure in which thin-film conductors and thin-film dielectrics are alternately laminated, instead of the main conductor 19 in the form of a single layer in the modification example 11 of FIG. 22. That is, characteristically, the main conductor 20 comprises a thin-film conductor 20*a,* a thin-film dielectric 40*b,* a thin-film conductor 20*b,* a thin-film dielectric 40*b,* a thin-film conductor 20*c,* a thin-film dielectric 40*c,* a thin-film conductor 20*d,* a thin-film dielectric 40*d,* and a thin-film conductor 20*e* laminated together, and in the main conductor 20, the thin-film conductors are formed so that a thin-film conductor lying at a position further inside is thicker.

In the high frequency low loss electrode of the modification example 12 configured as described above, the conductor loss of the main conductor can be reduced, and thereby, the loss can be decreased as compared with the modification example 11.

MODIFICATION EXAMPLE 13

Figure 24:
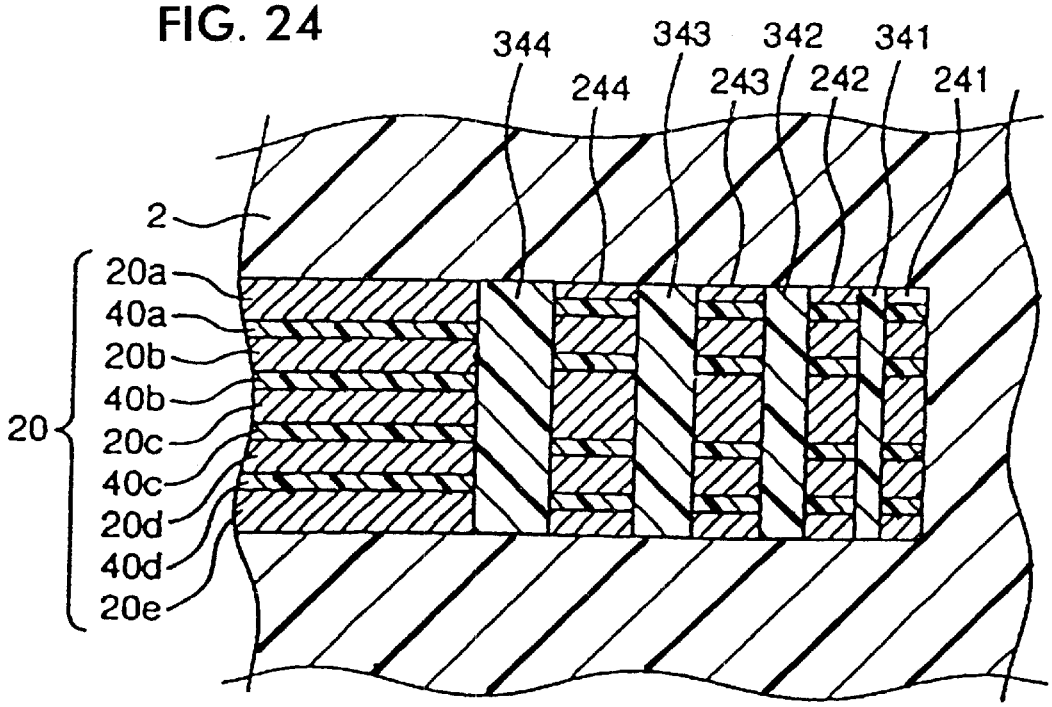
FIG. 24 is a cross-sectional view showing the configuration of the high frequency low loss electrode of a modification example 13 of the present invention.

Characteristically, the high frequency low loss electrode of the modification example 13, as shown in FIG. 24, is the same as the modification example 12 shown in FIG. 23 except that in the main conductor 20, as shown in FIG. 24, the respective thin-film conductors have the same thickness, and the thin-film dielectrics are the same thickness.

With this configuration, the high frequency low loss electrode of the modification example 13 is effective in reducing the conductor loss of the main conductor. The low loss can be realized as well as in the modification example 12.

MODIFICATION EXAMPLE 14

Figure 25:
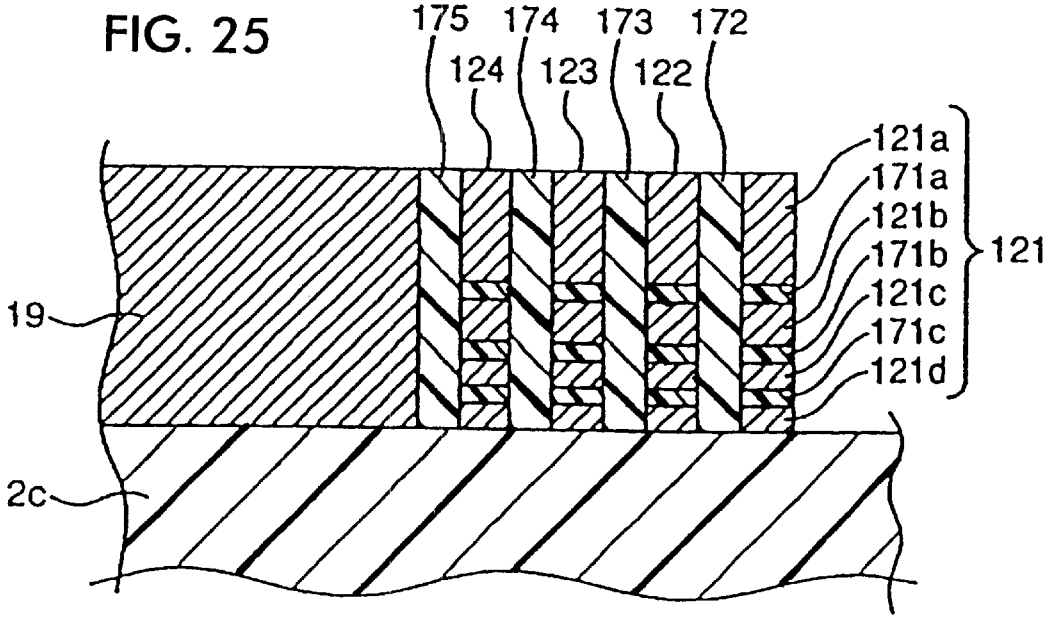
FIG. 25 is a cross-sectional view showing the configuration of the high frequency low loss electrode of a modification example 14 of the present invention.

The high frequency low loss electrode of the modification example 14 comprises sub-conductors 121, 122, 123, and 124, and sub-dielectrics 172, 173, 174, and 175 which are alternately disposed in the electrode end portion and formed on a dielectric substrate 2*c*, as shown in FIG. 25. In the modification example 14, the sub-conductors 121, 122, 123, and 124 have the same width, and moreover, the sub-dielectrics 172, 173, 174, and 175 have the same width.

Each sub-conductor comprises the thin-film conductors and the thin-film dielectrics laminated alternately. For example, each of the sub-conductors thin-film dielectric 171*a*, a thin-film conductor 121*b*, a thin-film dielectric 171*b*, a thin-film conductor 121*c*, a thin-film dielectric 171*c*, and a thin-film conductor 121*d* laminated together. The thin-film conductors are formed so that a thin-film conductor thereof positioned nearer to the surface (more distant from the substrate 2*c*) is thicker.

In the high frequency low loss electrode of the modification example 14 configured as described above, the conductor loss at a high frequency in the end portion can be reduced as compared with the conventional electrode.

As described above, particularly in FIG. 25, embodiments of the high frequency low loss electrode of the present invention having different configurations can be realized. The above embodiments and the modification examples are described in the case of three or four sub-conductors, as an example. Needless to say, the present invention is not limited to the three or four sub-conductors. For the configuration, fifty through one hundred or more sub-conductors may be used. The loss can be reduced more effectively by increasing the number of the sub-conductors and shortening the widths of the sub-conductors.

Further, according to the present invention, a superconductor may be used for a main conductor. If the superconductor is used for the main conductor, a current in the end portion of the main conductor can be decreased, and thereby, a relatively high current can be allowed to flow.

Moreover, according to the present invention, the conductivities of the sub-conductors may be set at different values. The dielectric constants of the sub-dielectrics may be set at different values.

Further, the low loss characteristics of the high frequency low loss electrode of the present invention can be utilized in various devices. Hereinafter, examples will be described of how the present invention can be applied.

Application Example 1

Figure 26B:
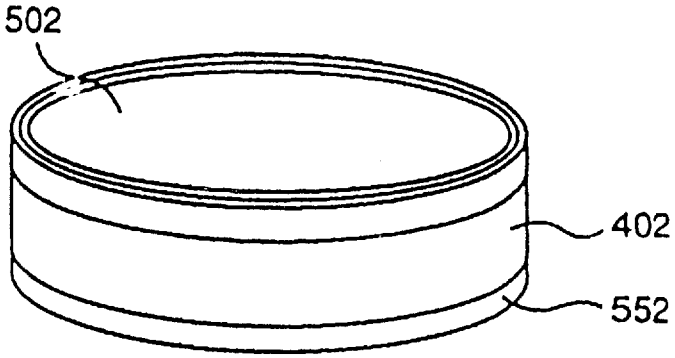
FIG. 26B is a perspective view showing the configuration of a circular resonator which is an application example 2 of a high frequency low loss electrode according to the present invention.
Figure 26D:
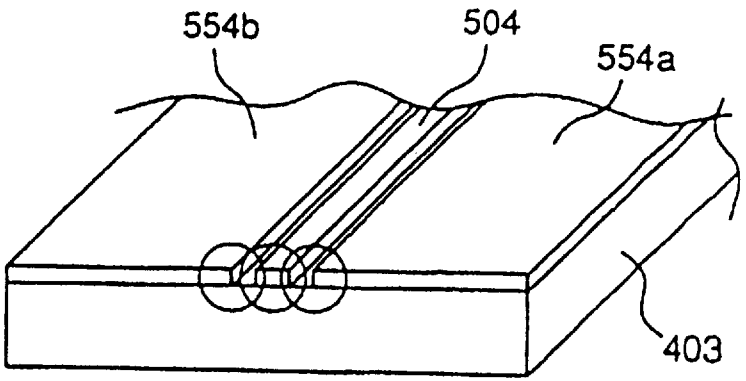
FIG. 26D is a perspective view showing the configuration of a coplanar line which is an application example 4 of a high frequency low loss electrode according to the present invention.
Figure 26A:
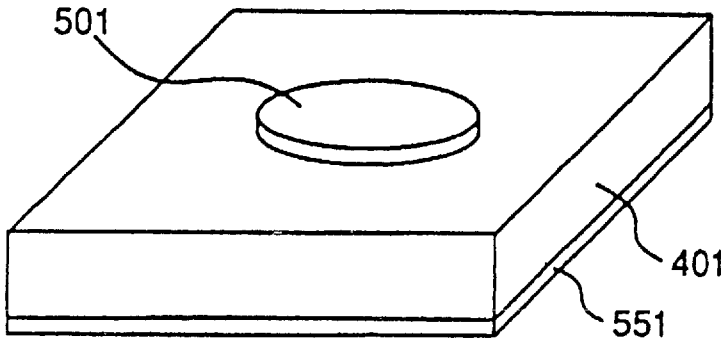
FIG. 26A is a perspective view showing the configuration of a circular strip resonator which is an application example 1 of a high frequency low loss electrode according to the present invention.

FIG. 26A is a perspective view showing the configuration of a circular strip resonator of the application example 1. The circular strip resonator comprises a rectangular dielectric substrate 401, a ground conductor 551 formed on the lower surface of the dielectric substrate 401, and a circular conductor 501 formed on the upper surface of the substrate 401. In this circular strip resonator, the circular conductor 501 is made of the high frequency low loss electrode of the present invention which has at least one sub-conductor running around its periphery, and thereby, the conductor loss in the peripheral portion can be reduced as compared with a conventional circular conductor having no sub-conductors. Consequently, in the circular strip resonator of the application example 1 of FIG. 26A, the unloaded Q can be increased as compared with the conventional circular strip resonator.

Application Example 2

FIG. 26B is a perspective view showing the configuration of a circular resonator of the application example 2. The circular resonator comprises a rectangular dielectric substrate 402, a ground conductor 552 formed on the lower surface of the circular dielectric substrate 402, and a circular conductor 502 formed on the upper surface of the circular substrate 402. In this circular strip resonator, the circular conductor 502 is made of the high frequency low loss electrode of the present invention which has at least one sub-conductor at the periphery. The conductor loss in the peripheral portion can be reduced as compared with a conventional circular conductor having no sub-conductors. Consequently, in the circular resonator of the application example 2 of FIG. 26B, the unloaded Q can be increased as compared with the conventional circular resonator. In the circular resonator of this application example 2, the ground conductor 552 may also be made of the high frequency low loss electrode of the present invention. With this configuration, the unloaded Q can be further enhanced.

Application Example 3

Figure 26C:
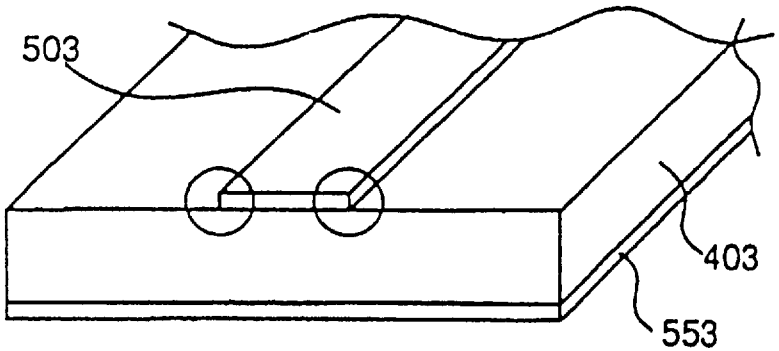
FIG. 26C is a perspective view showing the configuration of a microstrip line which is an application example 3 of a high frequency low loss electrode according to the present invention.

FIG. 26C is a perspective view showing the configuration of a microstrip line of the application example 3. The microstrip line comprises a dielectric substrate 403, a ground conductor 553 formed on the lower surface of the dielectric substrate 403, and a strip conductor 503 formed on the upper surface of the substrate 403. In this microstrip line, the strip conductor 503 is made of the high frequency low loss electrode of the present invention having at least one sub-conductor in each of the end portions (indicated by the circles in FIG. 26C) on the opposite sides of the strip conductor 503, and the conductor loss in the end portions can be reduced as compared with a conventional strip conductor having no sub-conductors. Consequently, in the microstrip line of the application example 3 of FIG. 26C, the transmission loss can be reduced as compared with a conventional microstrip line.

Application Example 4

FIG. 26D is a perspective view showing the configuration of a coplanar line of the application example 4. The coplanar line comprises a dielectric substrate 403, ground conductors 554*a* and 554*b* provided at a predetermined interval on the upper surface of the dielectric substrate 403, and a strip conductor 504 formed between the ground conductors 554*a* and 554*b*. In the coplanar line, the strip conductor 504 is made of the high frequency low loss electrode of the present invention which has at least one sub-conductor in each of the end portions (indicated by the circles in FIG. 26D) on the opposite sides of the strip conductor 504, and moreover, each of the ground conductors 554*a* and 554*b* is made of the high frequency low loss electrode of the present invention which has at least one sub-conductor on the inside end portion thereof (indicated by the circles in FIG. 26D). With this configuration of the coplanar line of the application example 4 of FIG. 26D, the transmission loss can be reduced as compared with a conventional coplanar line.

Application Example 5

Figure 27A:
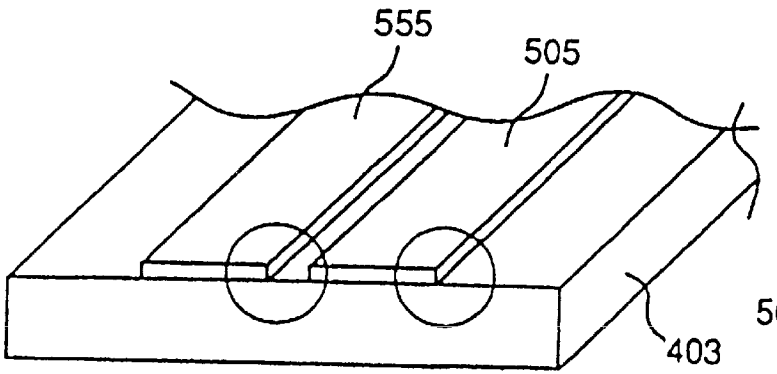
FIG. 27A is a perspective view showing the configuration of a coplanar strip line which is an application example 5 of a high frequency low loss electrode according to the present invention.

FIG. 27A is a perspective view showing the configuration of a coplanar strip line of the application example 5. The coplanar strip line comprises a dielectric substrate 403, a strip conductor 505 and a ground conductor 555 provided at a predetermined interval, in parallel on the upper surface of the dielectric substrate 403. In the coplanar strip line, the strip conductor 505 is made of the high frequency low loss electrode of the present invention which has at least one sub-conductor in each of the end portions (indicated by the circles in FIG. 27A) on the opposite sides thereof, and the ground conductor 555 is made of the high frequency low loss electrode of the present invention which has at least one sub-conductor on the inside end-portion thereof (indicated by the circle in FIG. 27A), opposed to the strip conductor 505. With this configuration, the transmission loss of the coplanar strip line of the application example 5 shown in FIG. 27A can be reduced as compared with a conventional coplanar strip line.

Application Example 6

Figure 27B:
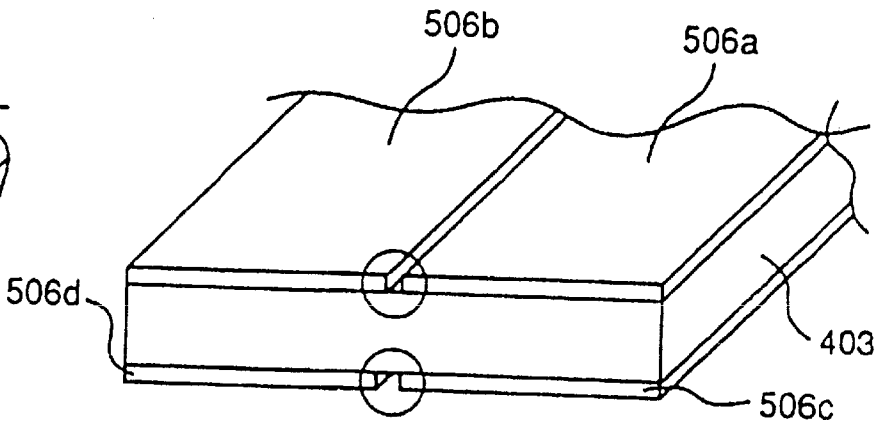
FIG. 27B is a perspective view showing the configuration of a parallel slot line which is an application example 6 of a high frequency low loss electrode according to the present invention.

FIG. 27B is a perspective view showing the configuration of a parallel slot line of the application example 6. The parallel slot line comprises the dielectric substrate 403, a conductor 506*a* and a conductor 506*b* formed at a predetermined interval on the upper surface of the dielectric substrate 403, and conductors 506*c* and 506*d* formed at a predetermined interval on the lower surface of the dielectric substrate 403. In the parallel slot line, the conductors 506*a* and 506*b* are made of the high frequency low loss electrode having at least one sub-conductor in the respective inside end portions (indicated by the circle in FIG. 27B) opposed to each other, respectively. The conductor 506*c* and the conductor 506*d* are made of the high frequency low loss electrode having at least one sub-conductor in the end portions (indicated by the circle in FIG. 27B) opposed to each other, respectively. With this configuration, in the parallel slot line of the application example 6 of FIG. 27B, the transmission is loss can be reduced as compared with a conventional parallel slot line.

Application Example 7

Figure 27C:
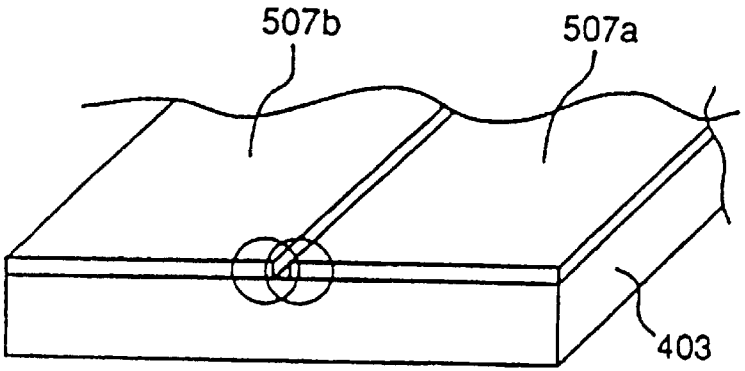
FIG. 27C is a perspective view showing the configuration of a slot line which is an application example 7 of a high frequency low loss electrode according to the present invention.

FIG. 27C is a perspective view showing the configuration of a slot line of the application example 7. The slot line comprises the dielectric substrate 403, conductors 507*a* and 507*b* formed at a predetermined interval on the upper surface of the dielectric substrate 403. In the slot line, the conductors 507*a* and 507*b* are made of the high frequency low loss electrode which have at least one sub-conductor in the inside end portions (indicated by the circles in FIG. 27C) opposed to each other, respectively. With this configuration, in the slot line of the application example 7 of FIG. 27C, the transmission loss can be reduced as compared with a conventional slot line.

Application Example 8

Figure 27D:
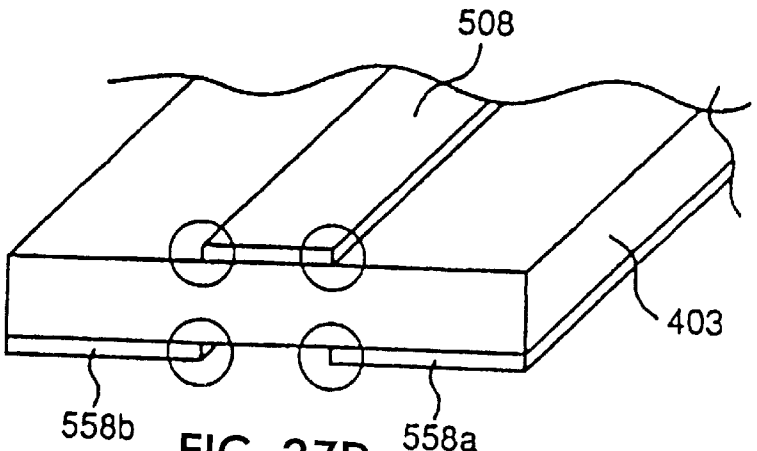
FIG. 27D is a perspective view showing the configuration of a high impedance microstrip line which is an application example 8 of a high frequency low loss electrode according to the present invention.

FIG. 27D is a perspective view showing the configuration of a high impedance microstrip line of the application example 8. The high impedance microstrip line comprises the dielectric substrate 403, a strip conductor 508 formed on the upper surface of the dielectric substrate 403, and ground conductors 558*a* and 558*b* formed at a predetermined interval on the lower surface of the dielectric substrate 403. In the high impedance microstrip line, the strip conductor 508 is made of the high frequency low loss electrode which has at least one sub-conductor in each of the end portions (indicated by the circles in FIG. 27D) on the opposite sides thereof. The ground conductors 558*a* and 558*b* have at least one sub-conductor in the respective inside end portions (indicated by the circles in FIG. 27D) thereof opposed to each other. With this configuration, in the high impedance microstrip line of the application example 8 of FIG. 27D, the transmission loss can be reduced as compared with a conventional high impedance microstrip line.

Application Example 9

Figure 28B:
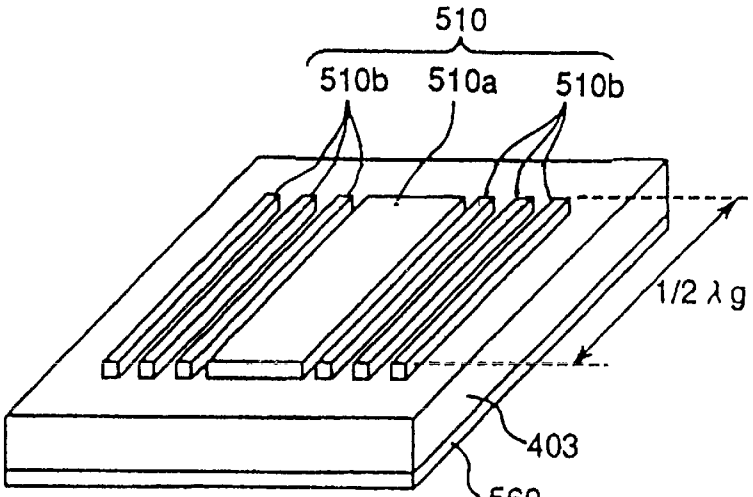
FIGS. 28B and 28C are perspective views each showing the configuration of a respective half-wave type microstrip line resonator which are application examples 10A and 10B of a high frequency low loss electrode according to the present invention.
Figure 28D:
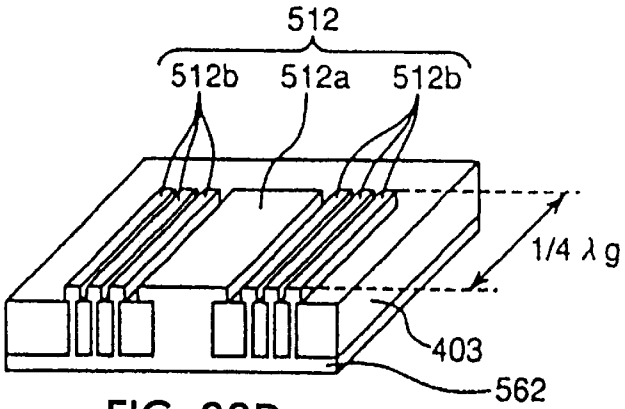
FIG. 28D is a perspective view showing the configuration of a quarter-wave type microstrip line resonator which is an application example 11 of a high frequency low loss electrode according to the present invention.
Figure 28A:
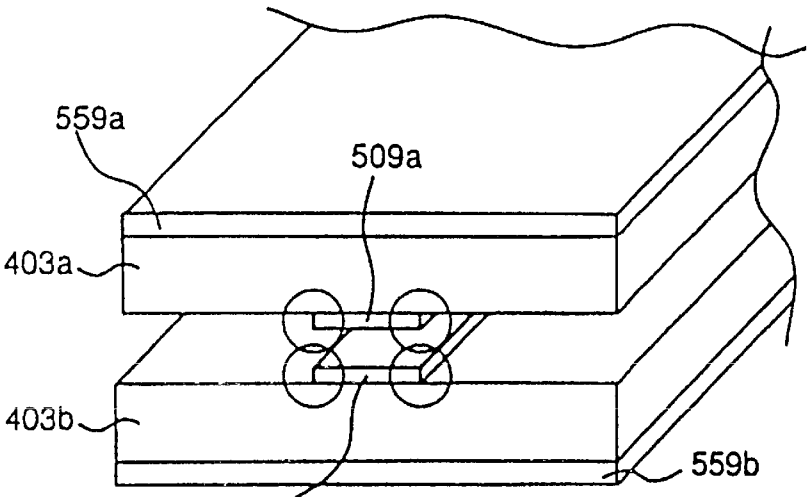
FIG. 28A is a perspective view showing the configuration of a slot line which is an application example 9 of a high frequency low loss electrode according to the present invention.

FIG. 28A is a perspective view showing the configuration of a parallel microstrip line of the application example 9. The parallel microstrip line comprises a dielectric substrate 403*a* having a ground conductor 559*a* formed on one side thereof and a strip conductor 509*a* formed on the other side thereof, and a dielectric substrate 403*b* having a ground conductor 559*b* formed on one side thereof, and a strip conductor 509*b* formed on the other side, in which the dielectric substrates 403*a* and 403*b* are arranged in parallel so that the strip conductors 509*a* and 509*b* are opposed to each other. In this parallel microstrip line, each of the strip conductors 509*a* and 509*b* is made of the high frequency low loss electrode of the present invention which has at least one sub-conductor in each of the opposite end portions (indicated by the circles in FIG. 28A) thereof. Consequently, in the parallel microstrip line of the application example 9 of FIG. 28A, the transmission loss can be reduced as compared with a conventional parallel microstrip line.

Application Example 10

FIG. 28B is a perspective view showing the configuration of a half-wave type microstrip line resonator of the application example 10. The half-wave type microstrip line resonator comprises the dielectric substrate 403, a ground conductor 560 formed on the lower surface of the dielectric substrate 403, and a strip conductor 510 formed on the upper surface of the dielectric substrate 403. In this half-wave type microstrip line resonator, the strip conductor 510 is made of the high frequency low loss electrode of the present invention, and comprises a main conductor 510*a,* and three sub-conductors 510*b* formed along each of the end-portions on the opposite sides of the main conductor 510*a*. The conductor loss in the end portions can be reduced as compared with a conventional strip conductor having no sub-conductors. Consequently, the unloaded Q of the half-wave microstrip line resonator of the application example 10 of FIG. 28B can be enhanced as compared with that of a conventional half-wave microstrip line resonator.

Figure 28C:
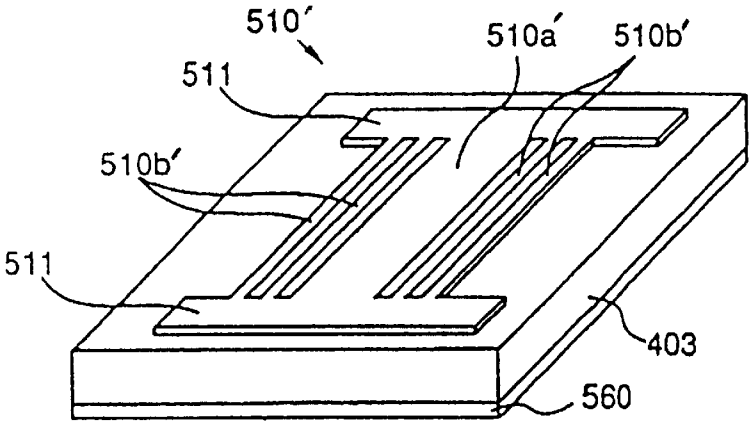

In another strip conductor 510' which is also a half-wave type microstrip line resonator, the main conductor 510*a*' and the sub-conductors 510*b*', as shown in FIG. 28C, may be connected to each other through conductors 511 provided on the opposite ends of them.

Application Example 11

FIG. 28D is a perspective view showing the configuration of a quarter-wave type microstrip line resonator of the application example 11. The quarter-wave type microstrip line resonator comprises the dielectric substrate 403, a ground conductor 562 formed on the lower surface of the dielectric substrate 403, and a strip conductor 512 formed on the upper surface of the dielectric substrate 403. In this quarter-wave type microstrip line resonator, the strip conductor 512 is made of the high frequency low loss electrode of the present invention, and comprises a main conductor 512*a,* and three sub-conductors 512*b* formed along each of the end portions of the main conductor 512*a* on the opposite sides thereof. The main conductor 512*a* and the sub-conductors 512*b* are connected to the ground conductor 562 on one side-face of the dielectric substrate 403. The unloaded Q of the quarter-wave type microstrip line resonator of the application example 11 of FIG. 28D configured as described above can be enhanced as compared with that of a conventional quarter-wave microstrip line resonator.

Application Example 12

Figure 29A:
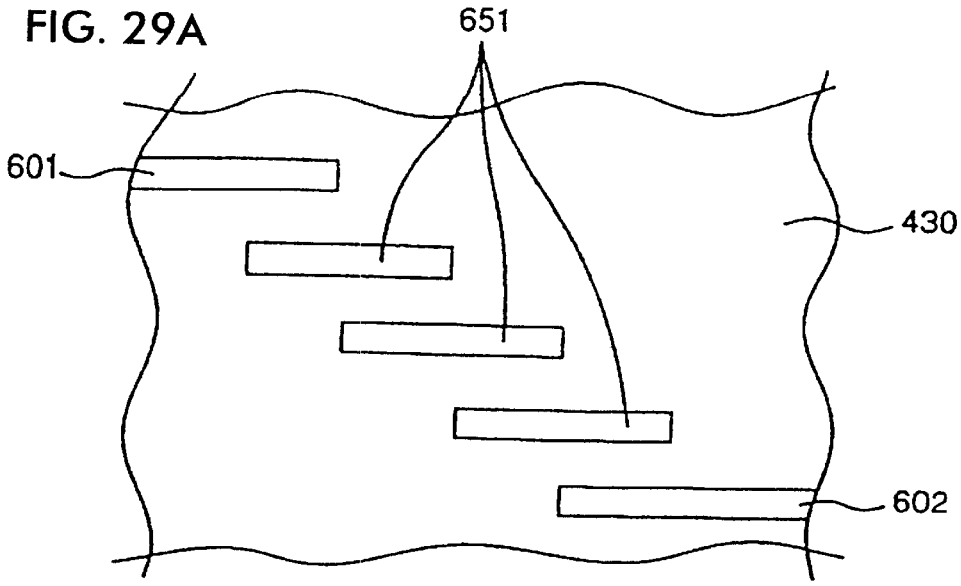
FIGS. 29A and 29B are plan views showing the configuration of a respective half-wave microstrip line filter which are application examples 12A and 12B of a high frequency low loss electrode according to the present invention.

FIG. 29A is a plan view showing the configuration of a half-wave microstrip line filter. The half-wave type microstrip line filter has the configuration in which three half-wave type microstrip line resonators 651 formed in the same manner as that of the application example 10 are arranged between an input microstrip line 601 and an output microstrip line 602, which are formed in the same manner as the application example 8, respectively. In the half-wave type microstrip line filter formed as described above, the transmission loss of the microstrip line 601 and the microstrip line 602 can be reduced. In addition, the unloaded Q of the half-wave type microstrip line resonator 651 can be enhanced. Accordingly, the insertion loss can be reduced, and moreover, the out-of-band attenuation can be increased, as compared with a conventional half-wave type microstrip line filter.

Figure 29B:
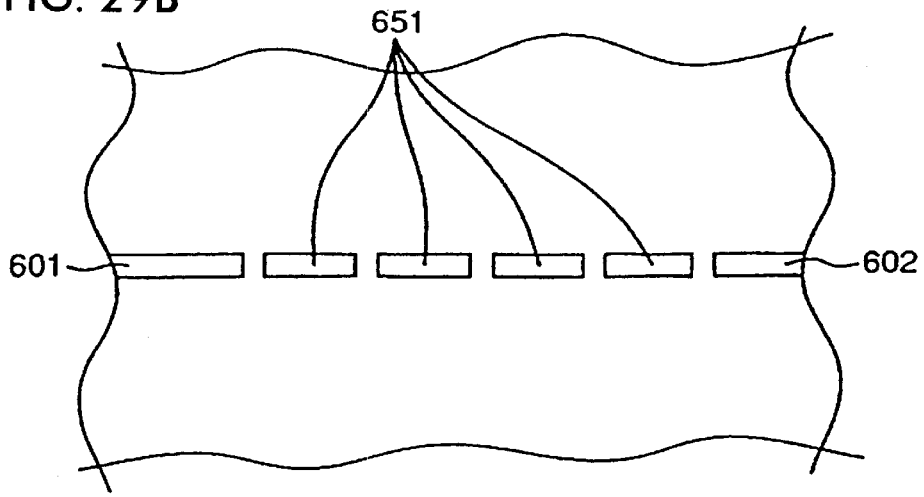

Further, in the half-wave type microstrip line filter of the application example 12, as shown in FIG. 29B, the half-wave type microstrip line resonators 651 may be arranged so that they are opposed to each other at their end-faces.

The number of the half-wave microstrip line resonators 651 is not limited to three or four.

Application Example 13

Figure 29C:
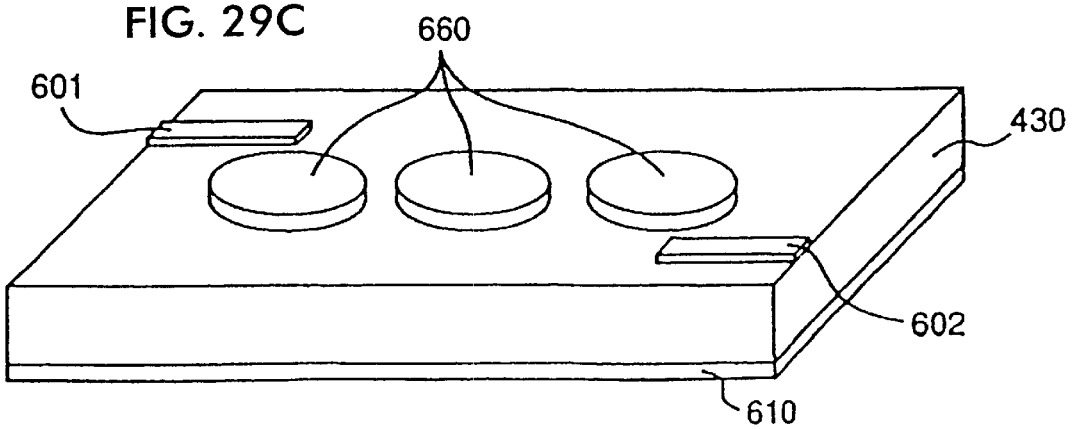
FIG. 29C is a plan view showing the configuration of a circular strip filter which is an application example 13 of a high frequency low loss electrode according to the present invention.

FIG. 29C is a plan view showing the configuration of a circular strip filter of the application example 13. The circular strip filter has the configuration in which three circular strip resonators 660 formed in the same manner as the application example 1 are arranged between the input microstrip line 601 and the output microstrip line 602, formed in the same manner as the application example 8. In the circular strip filter formed as described above, the transmission loss of the microstrip line 601 and the microstrip line 602 can be reduced, and moreover, the unloaded Q of the circular strip resonator 660 can be enhanced. Accordingly, the insertion loss can be reduced, and the out-of-band attenuation can be increased.

Further, in the circular strip filter of the application example 13, the number of the circular strip resonator 660 is not limited to three.

Application Example 14

Figure 30:
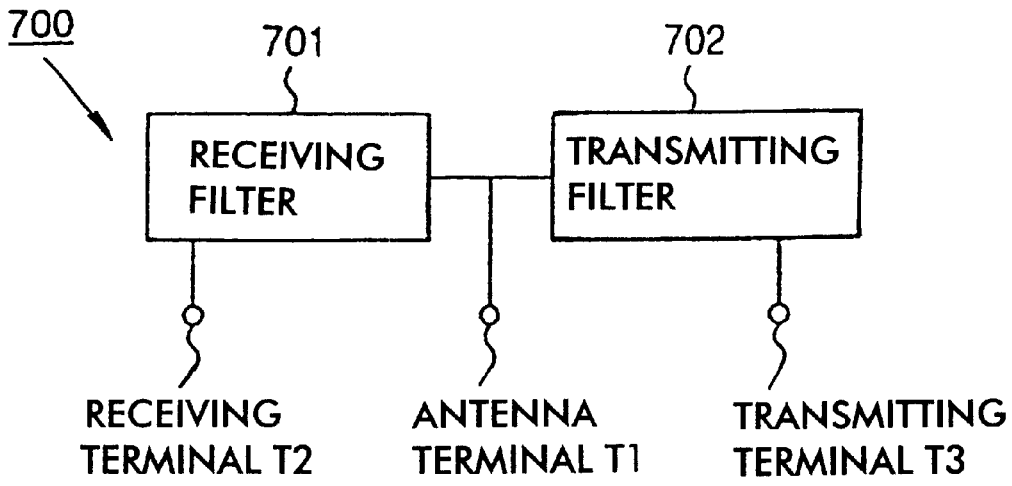
FIG. 30 is a block diagram showing the configuration of a duplexer 700 which is an application example 14.

FIG. 30 is a block diagram showing the configuration of a duplexer 700 of the application example 14. The duplexer 700 comprises an antenna terminal T1, a receiving terminal T2, a transmitting terminal T3, a receiving filter 701 provided between the antenna terminal T1 and the receiving terminal T2, and a transmitting filter 702 provided between the antenna terminal T1 and the transmitting terminal T3. In the duplexer 700 of the application example 14, the receiving filter 701 and the transmitting filter 702 are formed with the filter of the application example 12 or 13, respectively.

The duplexer 700 configured as described above has excellent separation characteristics for receiving and transmitting signals.

Figure 31:
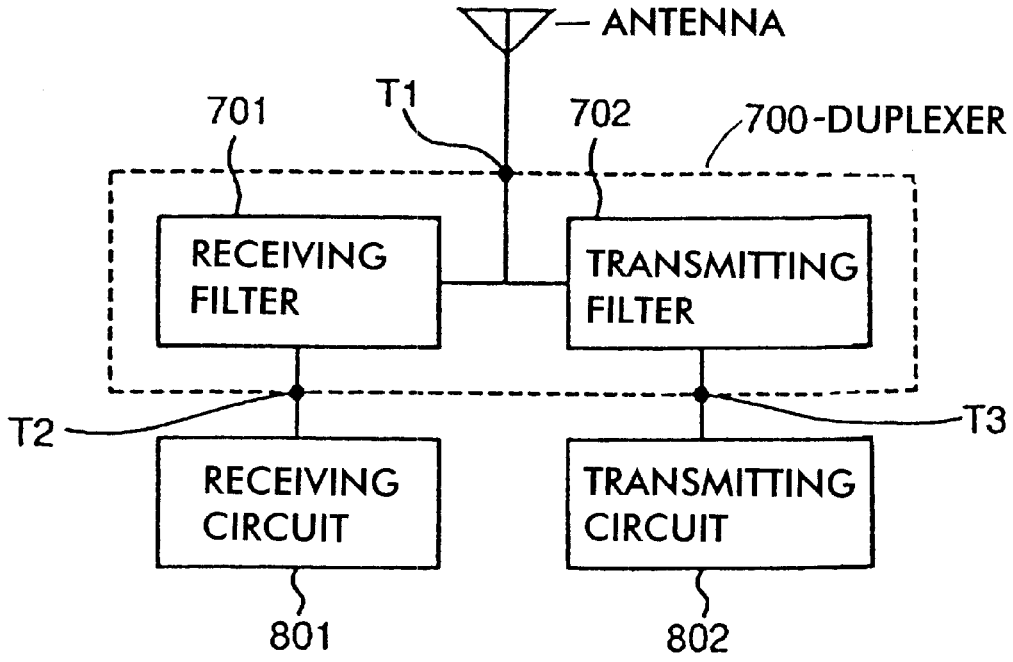
FIG. 31 illustrates the configuration of a communications device which is an application example 15 including the duplexer 700 of FIG. 30.

Further, in the duplexer 700, as shown in FIG. 31, an antenna is connected to the antenna terminal T1, a receiving circuit 801 to the receiving terminal T2, and a transmitting circuit 802 to the transmitting terminal T3, and is used as a portable terminal of a mobile communication system, as an example.

As seen in the above description, the first high frequency low loss electrode of the present invention comprises a main conductor, and at least one sub-conductor formed along a side of the main conductor, said at least one sub-conductor having a multi-layer structure in which thin-film conductors and thin-film dielectrics are laminated alternately. Accordingly, an electric field concentrated at the end portion of the electrode can be dispersed into the respective sub-conductors, and the conductor loss of a sub-conductor having a multi-layer structure can be reduced. Thus, the conductor loss at a high frequency can be decreased.

Preferably, in the first high frequency low loss electrode of the present invention, the sub-conductor positioned nearest to the outside of the sub-conductors is set at a width smaller than ($\pi/2$) times the skin depth $\delta$ and more preferably at a width smaller than ($\pi/4$) times the skin depth $\delta$ at an applied frequency. Accordingly, an ineffective current in the sub-conductor positioned nearest to the outside can be reduced, and thereby, the conductor loss at a high frequency can be effectively reduced.

When the first high frequency low loss electrode of the present invention includes plural sub-conductors, ineffective currents in the respective sub-conductors can be reduced, and moreover, the conductor loss at a high frequency can be decreased by setting the widths of the respective sub-conductors at a value smaller than ($\pi/2$) times the skin depth $\delta$ at an applied frequency.

Furthermore, when the first high frequency low loss electrode of the present invention includes plural sub-conductors, the conductor loss can be reduced more effectively by setting the thickness of a sub-conductor positioned nearer to the outside of the plural sub-conductors at a smaller value.

Preferably, in the first high frequency low loss electrode of the present invention, the interval between the main conductor and the sub-conductor adjacent to the main conductor, and the intervals between adjacent sub-conductors, are set so that an interval thereof positioned nearer to the outside is shorter, corresponding to the widths of the adjacent sub-conductors, in order to cause currents substantially in phase to flow through the respective sub-conductors. Thereby, the currents flowing through the respective sub-conductors can be effectively dispersed, and moreover, the conductor loss at a high frequency can be reduced.

Moreover, when the first high frequency low loss electrode of the present invention includes sub-dielectrics, the dielectric constants of the sub-dielectrics may be set so that the dielectric constant of a sub-dielectric thereof positioned nearer to the outside is lower, corresponding to the widths of the adjacent sub-conductors, in order to cause currents to flow substantially in phase through the respective sub-conductors. Thus, the conductor loss at a high frequency can be reduced.

Preferably, in the sub-conductors having a multi-layer structure of the first high frequency low loss electrode of the present invention, the thin-film conductors may be formed so that at positions further inside the multi-layer structure, the thin-film conductors are thicker. Accordingly, the conductor loss of the sub-conductor having a multi-layer structure can be reduced, and the conductor loss at a high frequency can be decreased.

The second high frequency low loss electrode of the present invention comprises a main conductor, and plural sub-conductors formed along a side of the main conductor. The sub-conductors are formed so that the width of a sub-conductor thereof positioned nearer to the outside thereof is smaller, and at least one of the sub-conductors has a multi-layer structure in which thin-film conductors and thin-film dielectrics are laminated alternately. Accordingly, currents can be dispersed and caused to flow through the plural sub-conductors. and the resistance of the sub-conductors having a multi-layer structure can be reduced, and thereby, the conductor loss at a high frequency can be decreased.

Preferably, in the second high frequency low loss electrode of the present invention, the width of at least one of the above sub-conductors is set preferably at a value up to ($\pi/2$) times the skin depth $\delta$ and more preferably at a value of up to ($\pi/4$) times the skin depth $\delta$ at an applied frequency. Thus, an ineffective current in the sub-conductors can be reduced, currents can be effectively dispersed in the sub-conductors, and the conductor loss at a high frequency can be decreased.

In the second high frequency low loss electrode of the present invention, currents substantially in phase can be efficiently dispersed in the respective sub-conductors, and the conductor loss at a high frequency can be reduced preferably by setting the intervals, and the widths and dielectric constants of the sub-dielectrics.

In the second high frequency low loss electrode of the present invention, the resistance losses of the sub-conductors at a high frequency can be decreased, and the conductor loss can be reduced at a high frequency preferably by forming the thin-film conductors of a sub-conductor having a multi-layer structure so that a thin-film conductor thereof lying at a position further inside is thicker.

The third high frequency low loss electrode of the present invention comprises a main conductor and plural sub-conductors formed along a side of the main conductor, the sub-conductors excluding the sub-conductor positioned nearest to the outside of the sub-conductors having a multi-layer structure in which thin-film conductors and thin-film dielectrics are laminated alternately, the sub-conductors being formed so that a sub-conductor thereof positioned nearer to the outside has fewer of the laminated thin-film conductors. Accordingly, currents can be effectively dispersed, the resistances of the respective sub-conductors can be decreased, and the conductor loss at a high frequency can be reduced.

The first high frequency resonator of the present invention includes any one of the above-described first through third high frequency low loss electrodes. Accordingly, the unloaded Q can be enhanced as compared with a conventional example.

The high frequency transmission line of the present invention includes any one of the first through third high frequency low loss electrodes of the present invention. Accordingly, the transmission loss can be reduced.

The high frequency filter of the present invention includes any one of the first through third high frequency resonators. Accordingly, the out-of-passband attenuation can be increased.

Further, the antenna sharing device and/or the communications device of the present invention includes the high frequency filter. Accordingly, the isolation between transmission and reception as well as out-of-band attenuation can be enhanced.

Although the present invention has been described in relation to particular embodiments thereof, many other variations and modifications and other uses will become apparent to those skilled in the art. Therefore, the present invention is not limited by the specific disclosure herein.

What is claimed is:

1. A high frequency low loss electrode comprising a main conductor, and at least one sub-conductor disposed along a side of the main conductor, said at least one sub-conductor having a multi-layer structure in which thin-film conductors and thin-film dielectrics are laminated alternately.

2. A high frequency low loss electrode according to claim 1, wherein said at least one sub-conductor has a width smaller than ($\pi/2$) times the skin depth $\delta$ at an applied frequency.

3. A high frequency low loss electrode according to claim 1, wherein said at least one sub-conductor has a width smaller than ($\pi/4$) times the skin depth $\delta$ at an applied frequency.

4. A high frequency low loss electrode according to claim 1, wherein the high frequency low loss electrode includes one or more additional said sub-conductors disposed between said side of said main conductor and said at least one sub-conductor, and each said additional sub-conductor has a width smaller than ($\pi/2$) times the skin depth $\delta$ at an applied frequency.

5. A high frequency low loss electrode according to claim 4, wherein said sub-conductors are disposed so that their thickness decreases toward the outside.

6. A high frequency low loss electrode according to any one of claims 4 and 5, wherein a plurality of sub-dielectrics are provided between the main conductor and the sub-conductor adjacent to the main conductor and between each pair of adjacent sub-conductors, respectively.

7. A high frequency low loss electrode according to claim 6, wherein the respective intervals between the main conductor and the sub-conductor adjacent to the main conductor, and between adjacent sub-conductors, become shorter toward the outside.

8. A high frequency low loss electrode according to claim 6, wherein a sub-dielectric positioned nearer to the outside has a lower dielectric constant than that of another sub-dielectric.

9. A high frequency low loss electrode according to claim 6, wherein the thin-film dielectrics in the multi-layer structure are disposed so that their thickness decreases toward the outside.

10. A high frequency low loss electrode comprising a main conductor, and a plurality of sub-conductors disposed along a side of the main conductor between said side of said main conductor and an outside of said sub-conductors, said sub-conductors being disposed so that a sub-conductor thereof positioned nearer to the outside has a smaller width, at least one of said sub-conductors having a multi-layer structure in which thin-film conductors and thin-film dielectrics are laminated alternately.

11. A high frequency low loss electrode according to claim 10, wherein at least one of said sub-conductors has a width smaller than ($\pi/2$) times the skin depth $\delta$ at an applied frequency.

12. A high frequency low loss electrode according to claim 11, wherein at least one of said sub-conductors has a width smaller than ($\pi/4$) times the skin depth $\delta$ at the applied frequency.

13. A high frequency low loss electrode according to any one of claims 10 through 12, wherein a plurality of sub-dielectrics are provided respectively between the main conductor and the sub-conductor adjacent to the main conductor and between adjacent pairs of sub-conductors.

14. A high frequency low loss electrode according to claim 13, wherein a sub-dielectric positioned nearer to the outside of said plurality of sub-dielectrics has a lower dielectric constant than that of another sub-dielectric.

15. A high frequency low loss electrode according to any one of claims 10 through 12, wherein the interval between the main conductor and the sub-conductor adjacent to the main conductor and the intervals between adjacent pairs of sub-conductors decrease toward the outside.

16. A high frequency low loss electrode according to any one of claims 10 through 12, wherein in the sub-conductor having a multi-layer structure, the thin-film conductors are disposed so that their thickness decreases toward the outside.

17. A high frequency low loss electrode comprising a main conductor and a plurality of sub-conductors formed along a side of the main conductor, the sub-conductors having a multi-layer structure in which thin-film conductors and thin-film dielectrics are laminated alternately, said sub-conductors being formed so that a sub-conductor thereof positioned nearer to the outside has fewer laminated thin-film conductors than another sub-conductor positioned farther from the outside.

18. A high frequency low loss electrode according to any one of claims 1, 10 and 17, wherein the main conductor is a thin-film multi-layer electrode comprising thin-film conductors and thin-film dielectrics laminated alternately.

19. A high frequency low loss electrode according to claim 18, wherein at least one of the main conductor and the sub-conductors comprises a superconductor.

20. A high frequency filter including the high frequency low loss electrode according to any one of claims 1, 10 and 17, further comprising an input electrode and an output electrode electromagnetically coupled to said high frequency low loss electrode.

21. A high frequency filter according to claim 20, wherein the high frequency low loss electrode has a length which is a quarter-wavelength at an applied frequency multiplied by an integer.

22. A high frequency filter according to claim 20, wherein the high frequency low loss electrode has a length which is a half-wavelength at an applied frequency multiplied by an integer.

23. An antenna sharing device comprising a transmitting filter and a receiving filter, wherein one of said filters is a high frequency filter according to claim 20.

24. A communications device comprising a transmitter and a receiver, and further comprising the antenna sharing device according to claim 23 connected between said transmitter and said receiver.

25. A communications device comprising the high frequency filter according to claim 20, and further comprising at least one of a transmitter and a receiver being connected to said filter.

26. A method of transmitting a signal having a predetermined frequency, comprising the steps of:

providing a high frequency low loss electrode comprising a main conductor, and at least one sub-conductor formed along a side of the main conductor, said at least one sub-conductor having a multi-layer structure in which thin-film conductors and thin-film dielectrics are laminated alternately, said electrode having a length corresponding to said predetermined frequency; and applying said signal to said electrode so as to transmit said signal.

27. A method according to claim 26, wherein said length is a quarter wavelength at said predetermined frequency.

28. A method according to claim 26, wherein said length is a half wavelength at said predetermined frequency.

29. A method of obtaining electromagnetic resonance at a predetermined frequency, comprising the steps of:

providing a high frequency low loss electrode comprising a main conductor, and at least one sub-conductor formed along a side of the main conductor, said at least one sub-conductor having a multi-layer structure in which thin-film conductors and thin-film dielectrics are laminated alternately, said electrode having a length corresponding to said predetermined frequency; and applying a signal having said frequency to said electrode so as to cause said electrode to resonate in response to said signal.

30. A method according to claim 29, wherein said length is a quarter wavelength at said predetermined frequency.

31. A method according to claim 29, wherein said length is a half wavelength at said predetermined frequency.

* * * * *